US006818074B2

(12) United States Patent
Matsuoka et al.

(10) Patent No.: US 6,818,074 B2
(45) Date of Patent: Nov. 16, 2004

(54) HIGH-DUCTILITY STEEL SHEET EXCELLENT IN PRESS FORMABILITY AND STRAIN AGE HARDENABILITY, AND METHOD FOR MANUFACTURING THE SAME

(75) Inventors: Saiji Matsuoka, Chiba (JP); Tetsuo Shimizu, Kurashiki (JP); Kei Sakata, Chiba (JP); Osamu Furukimi, Chiba (JP)

(73) Assignee: JFE Steel Corporation (JP)

( * ) Notice: Subject to any disclaimer, the term of this patent is extended or adjusted under 35 U.S.C. 154(b) by 74 days.

(21) Appl. No.: 10/163,728

(22) Filed: Jun. 6, 2002

(65) Prior Publication Data

US 2003/0106622 A1 Jun. 12, 2003

(30) Foreign Application Priority Data

| | | |
|---|---|---|
| Jun. 6, 2001 | (JP) | 2001-170402 |
| Jun. 29, 2001 | (JP) | 2001-198993 |
| Jul. 3, 2001 | (JP) | 2001-202067 |

(51) Int. Cl.[7] ..... C22C 38/02; C22C 38/16; C21D 8/04

(52) U.S. Cl. ..... 148/332; 148/320; 148/602; 148/654; 148/661

(58) Field of Search ..... 148/320, 332, 148/602, 654, 661

(56) References Cited

U.S. PATENT DOCUMENTS 6,190,469 B1 * 2/2001 Koh et al.

FOREIGN PATENT DOCUMENTS

| | | |
|---|---|---|
| JP | 5-24979 | 4/1993 |
| JP | 8-23048 | 3/1996 |
| JP | 2802513 | 7/1998 |
| JP | 10-310824 | 11/1998 |
| JP | 11-199975 | 7/1999 |

* cited by examiner

*Primary Examiner*—Deborah Yee
(74) *Attorney, Agent, or Firm*—Piper Rudnick LLP

(57) ABSTRACT

A steel sheet composition contains appropriate amounts of C, Si, Mn, P, S, Al and N and 0.5 to 3.0% Cu. A composite structure of the steel sheet has a ferrite phase or a ferrite phase and a tempered martensite phase as a primary phase, and a secondary phase containing retained austenite in a volume ratio of not less than 1%. In place of the Cu, at least one of Mo, Cr, and W may be contained in a total amount of not more than 2.0%. This composition is useful in production of a high-ductility hot-rolled steel sheet, a high-ductility cold-rolled steel sheet and a high-ductility hot-dip galvanized steel sheet having excellent press formability and excellent stain age hardenability as represented by a ΔTS of not less than 80 MPa, in which the tensile strength increases remarkably through a heat treatment at a relatively low temperature after press forming.

12 Claims, 3 Drawing Sheets

HIGH-DUCTILITY STEEL SHEET EXCELLENT IN PRESS FORMABILITY AND STRAIN AGE HARDENABILITY, AND METHOD FOR MANUFACTURING THE SAME

BACKGROUND OF THE INVENTION

1. Field of the Invention

The present invention relates mainly to steel sheets for automobiles, and more particularly, to high-ductility steel sheets having very high strain age hardenability and excellent press formability such as ductility, stretch-flanging formability, and drawability, in which the tensile strength increases remarkably through a heat treatment after press forming, and to methods for manufacturing the same. The term "steel sheets" as herein used shall include hot-rolled steel sheets, cold-rolled steel sheets, and hot-dip galvanized steel sheets. The term "steel sheets" as herein used shall also include steel sheets and steel strips.

2. Description of the Related Art

In recent years, weight reduction in automobile bodies has become a very important issue in relation to emission gas control for the purpose of preserving global environments. More recently, efforts are made to achieve higher strength of automotive steel sheets and to reduce steel sheet thickness in order to reduce the weights of automobile bodies.

Because most of the body parts of automobiles made of steel sheets are formed by press working, steel sheets used must have excellent press formability. In order to achieve excellent press formability, it is necessary to ensure high ductility. Stretch flanging is frequently applied, so that the steel sheets to be used must have a high hole-expanding ratio. In general, however, a higher strength of steel sheet tends to result in a lower ductility and a lower hole-expanding ratio, thus leading to poor press formability. As a result, there has conventionally been an increasing demand for high-strength steel sheets having high ductility and excellent press formability.

Importance is now placed on safety of an automobile body to protect a driver and passengers upon collision, and for this purpose, steel sheets must have improved impact resistance as a standard of safety upon collision. For the purpose of improving the crashworthiness, a higher strength in a completed automobile is more favorable. There has therefore been the strongest demand for steel sheets having low strength, high ductility, and excellent press formability upon forming automobile parts, and having high strength and excellent crashworthiness in completed products.

To satisfy such a demand, a steel sheet high both in press formability and strength was developed. This is a bake hardenable type steel sheet of which the yield stress increases by applying a bake treatment including holding at a high temperature of 100 to 200° C. after press forming. In this steel sheet, the C content remaining finally in a solid solution state (solute C content) is controlled within an appropriate range so as to keep the softness, shape fixability, and ductility during press forming. In a bake treatment performed after the press forming of this steel sheet, the solute C is fixed to a dislocation introduced during the press forming and inhibits the movement of the dislocation, thus resulting in an increase in yield stress. In this bake hardenable type automotive steel sheet, the yield stress can be increased, but the tensile strength cannot be increased.

Japanese Examined Patent Application Publication No. 5-24979 discloses a bake hardenable high-strength cold-rolled steel sheet having a composition comprising C: 0.08 to 0.20%, Mn: 1.5 to 3.5% and the balance Fe and incidental impurities, and having a structure composed of uniform bainite containing not more than 5% of ferrite or composed of bainite partially containing martensite. The cold-rolled steel sheet disclosed in Japanese Examined Patent Publication No. 5-24979 is manufactured by rapidly cooling the steel sheet to a temperature in the range of 400 to 200° C. in the cooling step after continuous annealing and then slowly cooling the same. A high degree of baking hardening conventionally unavailable is thereby achieved through conversion from the conventional structure mainly comprising ferrite to a structure mainly comprising bainite in the steel sheet.

In the steel sheet disclosed in Japanese Examined Patent Application Publication No. 5-24979, a high degree of baking hardening conventionally unavailable is obtained through an increase in yield strength after bake treatment. Even in this steel sheet, however, it is yet difficult to increase tensile strength after the bake treatment, and an improvement in crashworthiness cannot still be achieved.

On the other hand, some hot-rolled steel sheets are proposed with a view to increasing not only yield stress but also tensile strength by applying a heat treatment after press forming.

For example, Japanese Examined Patent Application Publication No. 8-23048 proposes a method for manufacturing a hot-rolled steel sheet comprising the steps of reheating a steel containing C: 0.02 to 0.13%, Si: not more than 2.0%, Mn: 0.6 to 2.5%, sol. Al: not more than 0.10%, and N: 0.0080 to 0.0250% to a temperature of not less than 1,100° C. and applying hot finish rolling at a temperature of 850 to 950° C. The method also comprising the steps of cooling the hot-rolled steel sheet at a cooling rate of not less than 15° C./second to a temperature of less than 150° C., and coiling the same, thereby forming a composite structure mainly comprising ferrite and martensite. In the steel sheet manufactured by the technique disclosed in Japanese Examined Patent Application Publication No. 8-23048, the tensile strength and the yield stress increase by strain age hardening; however, a serious problem is posed in that coiling of the steel sheet at a very low coiling temperature as less than 150° C. results in large variations in mechanical properties. Another problem includes a large variation in increment of yield stress after press forming and bake treatments, as well as poor press formability due to a low hole-expanding ratio ($\lambda$) and decreased stretch-flanging workability.

Japanese Unexamined Patent Application Publication No. 11-199975 proposes a hot-rolled steel sheet for working excellent in fatigue characteristics, containing C: 0.03 to 0.20%, appropriate amounts of Si, Mn, P, S and Al, Cu: 0.2 to 2.0%, and B: 0.0002 to 0.002%, of which the microstructure is a composite structure comprising ferrite as a primary phase and martensite as a second phase, and the ferrite phase contains Cu in a solid-solution and/or precipitation state of not more than 2 nm. The steel sheet disclosed in Japanese Unexamined Patent Application Publication No. 11-199975 has an object based on the fact that the fatigue limit ratio is remarkably improved only when Cu and B are added in combination, and Cu is present in an ultra fine state not more than 2 nm. For this purpose, it is essential to complete hot finish rolling at a temperature above the $A_{r3}$ transformation point, air-cool the sheet within the temperature region of $A_{r3}$ to $A_{r1}$ for 1 to 10 seconds, cool the sheet at a cooling rate of not less than 20° C./second, and coil the cooled sheet at a temperature of not more than 350° C. A low coiling temperature of not more than 350° C. causes serious deformation of the shape of the hot-rolled steel sheet, thus inhibiting industrially stable manufacture.

On the other hand, some automobile parts must have high corrosion resistance. A hot-dip galvanized steel sheet is suitable as a material applied to portions requiring high corrosion resistance. For this reason, a particular demand exists for hot-dip galvanized steel sheets excellent in press formability during forming, and is considerably hardened by a heat treatment after the forming.

To respond to such a demand, for example, Japanese Patent Publication No. 2802513 proposes a method for manufacturing a hot-dip galvanized steel sheet using a hot-rolled steel sheet as a black plate. The method comprises the steps of hot-rolling a steel slab containing C: not more than 0.05%, Mn: 0.05 to 0.5%, Al: not more than 0.1% and Cu: 0.8 to 2.0% at a coiling temperature of not more than 530° C. The method further comprising the subsequent steps of reducing the steel sheet surface by heating the hot-rolled steel sheet to a temperature of not more than 530° C., and hot-dip-galvanizing the sheet, whereby remarkable hardening is available through a heat treatment after forming. In the steel sheet manufactured by this method, however, the heat treatment temperature must be high as not less than 500° C., in order to obtain remarkable hardening from the heat treatment after the forming, and this has a problem in practice.

Japanese Unexamined Patent Application Publication No. 10-310824 proposes a method for manufacturing an alloyed hot-dip galvanized steel sheet having increased strength by a heat treatment after forming, using a hot-rolled or cold-rolled steel sheet as a black plate. This method comprises the steps of hot-rolling a steel containing C: 0.01 to 0.08%, appropriate amounts of Si, Mn, P, S, Al and N, and at least one of Cr, W and Mo: 0.05 to 3.0% in total. The method further comprises the step of cold-rolling or temper-rolling and annealing the sheet. The method still further comprises the step of applying hot-dip galvanizing to the sheet and heating the sheet for alloying treatment. The tensile strength of the steel sheet is increased by heating the sheet at a temperature within the range of 200 to 450° C. However, the resultant steel sheet involves a problem in that the microstructure comprises a ferrite single phase, a ferrite and pearlite composite structure, or a ferrite and bainite composite structure; hence, high ductility and low yield strength are unavailable, resulting in low press formability.

SUMMARY OF THE INVENTION

The present invention was made in view of the fact that, in spite of the strong demand as described above, a technique for industrially stably manufacturing a steel sheet satisfying these properties has never been found. The present invention solves the problems described above. It is an object of the present invention to provide is directed to high-ductility and high-strength steel sheets suitable for automobiles and having excellent press formability and excellent strain age hardenability, in which the tensile strength increases considerably through a heat treatment at a relatively low temperature after press forming. It is also an object of the present invention to provide a manufacturing method capable of stably manufacturing the high-ductility and high-strength steel sheets.

To achieve the above-mentioned object of the invention, the inventors carried out extensive studies on the effect of the steel sheet structure and alloying elements on strain age hardenability. As a result, the inventors found that a steel sheet having high age hardenability which leads to both an increase in yield stress and a remarkable increase in tensile strength can be obtained after a pre-deformation treatment with a prestrain of not less than 5% and a heat treatment at a relatively low temperature as within the range of 150 to 350° C. by (1) forming a composite structure of the steel sheet comprising ferrite and a phase containing retained austenite in a volume ratio of not less than 1%, and (2) limiting the C content within the range of a low-carbon region to a medium-carbon region and containing Cu within an appropriate range or at least one of Mo, Cr, and W in place of Cu. In addition, the steel sheet was found to have satisfactory ductility, a high hole expanding ratio, and excellent press formability.

The results of a fundamental experiment carried out by the inventors on hot-rolled steel sheets will first be described.

A sheet bar having a composition comprising, in weight percent, C: 0.10%, Si: 1.4%, Mn: 1.5%, P: 0.01%, S: 0.005%, Al: 0.04%, N: 0.002% and Cu: 0.3 or 1.3% was heated to 1,250° C. and soaked. Then, the sheet bar was subjected to three-pass rolling into a thickness of 2.0 mm so that the finish rolling end temperature was 850° C. Thereafter, cooling conditions and the coiling temperature were changed variously to convert a single ferrite structure steel sheet into a hot-rolled steel sheet with a composite structure composed of ferrite as a primary phase and a retained austenite-containing phase as a secondary phase (hereinafter, referred to also as a composite ferrite/retained austenite structure).

Tensile properties were investigated by a tensile test on the resultant hot-rolled steel sheets. A pre-deformation treatment of a tensile prestrain of 5% was applied to each test piece sampled from these hot-rolled steel sheets. Then, after applying a heat treatment at 50 to 350° C. for 20 minutes, a tensile test was carried out to determine tensile properties, and the strain age hardenability was evaluated.

The strain age hardenability was evaluated in terms of the increment ΔTS that is a difference between the tensile strength $TS_{HT}$ after heat treatment and the tensile strength TS before the heat treatment. That is, ΔTS=(tensile strength $TS_{HT}$ after heat treatment)−(tensile strength TS before pre-deformation treatment). The tensile test was carried out by using JIS No. 5 tensile test pieces sampled in the rolling direction.

FIG. 1 illustrates the effect of the Cu content on the relationship between ΔTS and the steel sheet structure. A pre-deformation treatment of a tensile prestrain of 5% and then a heat treatment of 250° C. for 20 minutes were applied to the test pieces. The increment ΔTS was determined from the difference in tensile strength TS between before and after the heat treatment. FIG. 1 suggests that, for a Cu content of 1.3 wt. %, a high strain age hardenability as represented by a ΔTS of not less than 80 MPa is obtained by forming a composite ferrite/retained austenite steel sheet structure. For a Cu content of 0.3 wt. %, ΔTS is less, than 80 MPa, irrespective of the steel sheet structure, and high strain age hardenability cannot be obtained.

It is possible to manufacture a hot-rolled steel sheet having a high strain age hardenability by limiting the Cu content within an appropriate range, and forming a composite structure having ferrite as a primary phase and a retained austenite-containing phase as a secondary phase.

FIG. 2 illustrates the effect of the Cu content on the relationship between ΔTS and the heat treatment temperature after pre-strain treatment. The microstructure of the steel sheet is a composite structure having ferrite as a primary phase and a retained austenite-containing phase as a secondary phase, and the volume ratio of the retained austenite structure is 8% of the entire structure.

FIG. 2 shows that the increment ΔTS increases as the heat treatment temperature increases and strongly depends on the Cu content. With a Cu content of 1.3 wt. %, a high strain age hardenability as represented by a ΔTS of not less than 80 MPa is obtained at a heat treatment temperature of not less than 150° C. For a Cu content of 0.3 wt. %, ΔTS is less than 80 MPa at any heat treatment temperature, and high strain age hardenability cannot be obtained.

In addition, a hole expanding test was carried out on steel sheets having a single ferrite structure or a composite ferrite/retained austenite structure, and Cu contents of 0.3 wt % and 1.3 wt %, and the hole expanding ratio λ was determined. In the hole expanding test, punch holes were formed in test pieces through punching with a punch having a diameter of 10 mm. Thereafter, hole expansion was conducted with a conical punch having a vertical angle of 60 degrees so that the burr was outside, until cracks passing through the sheet in the thickness direction form. The hole expanding ratio λ was determined by the formula: $\lambda(\%)=\{(d-d_0)/d_0\}\times 100$ where $d_0$ represents the initial hole diameter, and d represents the hole inside diameter on occurrence of cracks.

In the case of a Cu content of 1.3 wt %, a hot-rolled steel sheet having a composite ferrite/retained austenite structure had a hole expanding ratio of about 140%, and a hot-rolled steel sheet having a single ferrite structure also had a hole expanding ratio of about 140%. In contrast, in the case of a Cu content of 0.3 wt %, a hot-rolled steel sheet having a single ferrite structure had a hole expanding ratio of 120%, and a hot-rolled steel sheet having a composite ferrite/retained austenite structure had a hole expanding ratio of about 80%.

As described above, it is clear that the hot-rolled steel sheet having a composite ferrite/retained austenite structure has an increased hole expanding ratio and that hole expanding formability is improved with an increased Cu content. A detailed mechanism of the improvement in hole expanding formability by Cu has not yet been clarified. The contained Cu is considered to reduce the difference in hardness between the ferrite/retained austenite and the strain-induced transformed martensite.

In the hot-rolled steel sheet of the present invention, very fine Cu precipitates in the steel sheet as a result of a pre-deformation with a strain of 2% or more as measured upon measuring the increment of deformation stress from before to after a usual heat treatment and the heat treatment carried out at a relatively low temperature in the range of 150 to 350° C. According to a study carried out by the present inventors, high strain age hardenability bringing about an increase in yield stress and a remarkable increase in tensile strength probably achieved by the precipitation of very fine Cu. Such precipitation of very fine Cu by a heat treatment in a low-temperature region has never been observed in ultra-low carbon steel or low-carbon steel in reports so far released. A reason for precipitation of very fine Cu in a heat treatment at a low temperature has not as yet been clarified to date. However, it is presumable as follows. During isothermal holding in the temperature range of 620 to 780° C. or during slow cooling from this temperature range after rapid cooling subsequent to hot rolling, a large amount of Cu is distributed to the γ phase. After cooling, Cu is dissolved in the retained austenite in a supersaturation state. The retained austenite is transformed into martensite by a prestrain of not less than 5%, and very fine Cu precipitates in the strain-induced transformed martensite during a subsequent low-temperature treatment.

Next, the results of a fundamental experiment carried out by the present inventors on the cold-rolled steel sheet will be described.

A sheet bar having a composition comprising, in weight percent, C: 0.10%, Si: 1.2%, Mn: 1.4%, P: 0.01%, S: 0.005%, Al: 0.03%, N: 0.002%, and Cu: 0.3 or 1.3% was heated to 1,250° C., soaked and subjected to three-pass rolling into a thickness of 4.0 mm so that the finish rolling end temperature was 900° C. After the completion of finish rolling, a temperature holding equivalent treatment of 600° C. for 1 hour was applied as a coiling treatment. Thereafter, the sheet was cold-rolled at a reduction of 70% into a cold-rolled steel sheet having a thickness of 1.2 mm. Then, the cold-rolled sheet was heated at a temperature in the range of 700 to 850° C. and soaked for 60 seconds. Thereafter, the sheet was cooled to 400° C., and was held at the temperature (400° C.) for 300 seconds for recrystallization annealing. By the recrystallization annealing, various cold-rolled steel sheets were obtained in which the structure changed from a single ferrite structure to a composite ferrite/retained austenite structure.

Tensile tests were conducted on the resultant cold-roll steel sheets as in the hot-rolled steel sheets to determine tensile properties. Tensile properties (YS, TS) were determined by sampling test pieces from these cold-rolled steel sheets, applying a pre-deformation treatment with a tensile prestrain of 5% to these test pieces, then heating the steel sheets at 50 to 350° C. for 20 minutes, and then conducting the tensile tests.

The strain age hardenability was evaluated in terms of the tensile strength increment ΔTS from before to after the heat treatment, as in the hot-rolled steel sheet.

FIG. 3 illustrates the effect of the Cu content on the relationship between ΔTS and the recrystallization annealing temperature. The value ΔTS was determined by applying a pre-deformation treatment with a tensile prestrain of 5% to test pieces sampled from the resultant cold-rolled steel sheets, conducting a heat treatment of 250° C. for 20 minutes, and carrying out a tensile test.

FIG. 3 suggests that a high strain age hardenability as represented by a ΔTS of not less than 80 MPa is available, in the case of a Cu content of 1.3 wt. %, by employing a recrystallization annealing temperature of not less than 750° C. to convert the steel sheet structure into a composite ferrite/retained austenite structure. On the other hand, in the case of a Cu content of 0.3 wt. %, high strain age hardenability is unavailable because ΔTS is less than 80 MPa at any recrystallization annealing temperature. FIG. 3 suggests the possibility of manufacturing a cold-rolled steel sheet having a high strain age hardenability by optimizing the Cu content and forming a composite ferrite/retained austenite structure.

FIG. 4 illustrates the effect of the Cu content on the relationship between ΔTS and the heat treatment temperature after pre-strain treatment. The steel sheet used was annealed at 800° C., which was the dual phase region of ferrite (α)+austenite (γ), for a holding time of 60 seconds after cold rolling, cooled from the holding temperature (800° C.) to 400° C. at a cooling rate of 30° C./second, and held at 400° C. for 300 seconds. The steel sheets had a composite ferrite/retained austenite (secondary phase) microstructure, the volume ratio of the retained austenite structure being 4%.

FIG. 4 shows that the increment ΔTS increases as the heat treatment temperature increases and strongly depends on the Cu content. With a Cu content of 1.3 wt. %, a high strain age hardenability as represented by a ΔTS of not less than 80 MPa is obtained at a heat treatment temperature of not less than 150° C. For a Cu content of 0.3 wt. %, ΔTS is less than 80 MPa at any heat treatment temperature, and high strain age hardenability cannot be obtained.

In addition, a hole expanding test was carried on cold-rolled steel sheets having a composite ferrite/retained austenite structure and Cu contents of 0.3 wt % and 1.3 wt. % to determine the hole expanding ratio (λ), as in the hot-rolled steel sheet.

In the cold-rolled steel sheet with a Cu content of 1.3%, λ was 130%; while in the cold-rolled steel sheet with a Cu content of 0.3%, λ was 60%. It is clear that, for a Cu content of 1.3 wt. %, the hole expanding ratio is increased and hole expanding formability is improved even in the cold-rolled steel sheet, as in the hot-rolled steel sheet. A detailed mechanism of improvement in hole expanding formability with content of Cu has not yet been clarified, as in the hot-rolled steel sheet. Also, in the cold-rolled steel sheet, it is considered that the contained Cu reduces the difference in hardness between the ferrite/retained austenite structure and the strain-induced transformed martensite structure.

In the cold-rolled steel sheet of the present invention, very fine Cu precipitates in the steel sheet as a result of a pre-deformation with a strain larger than 2%, which is equivalent to the prestrain on measuring the deformation stress increment from before to after a usual heat treatment, and a heat treatment at a relatively low temperature of 150 to 350° C. According to a study carried out by the present inventors, also in the cold-rolled steel sheet, high strain age hardenability bringing about an increase in yield stress and a remarkable increase in tensile strength is probably achieved by the precipitation of very fine Cu. A reason for precipitation of very fine Cu in a heat treatment in a low temperature region has not as yet been clarified to date. However, it is presumable as follows. During recrystallization annealing in the dual phase region of α+γ, a large amount of Cu is distributed to the γ phase. The distributed Cu remains even after cooling and is dissolved into the martensite in a supersaturation state, and very fine Cu precipitates through a prestrain of not less than 5% and a low-temperature treatment.

Next, the result of a fundamental experiment carried out by the present inventors on the hot-dip galvanized steel sheet will be described.

A sheet bar having a composition comprising, in weight percent, C: 0.08%, Si: 0.5%, Mn: 2.0%, P: 0.01%, S: 0.004%, Al: 0.04%, N: 0.002% and Cu: 0.3 or 1.3% was heated to 1,250° C. and soaked. Then, the sheet bar was subjected to three-pass rolling into a thickness of 4.0 mm so that the finish rolling end temperature was 900° C. After the finish rolling, a temperature holding equivalent treatment of 600° C. for 1 h was applied as a coiling treatment. Thereafter, the hot-rolled sheet was cold-rolled at a reduction of 70% into a cold-rolled steel sheet having a thickness of 1.2 mm. Then, the cold-rolled sheet was heated and soaked at 900° C., and cooled at a cooling rate of 30° C./sec. (a primary heat treatment). The steel sheet after the primary heat treatment had a lath martensite structure. The steel sheet after the primary heat treatment was subjected to a secondary heat treatment at various temperatures, then rapidly cooled to a temperature in the range of 450 to 500° C. Then, the sheet was immersed into a hot-dip galvanizing bath (0.13 wt. % Al—Zn bath) to form a hot-dip galvanizing layer on the surface. Further, the sheet was reheated to a temperature in the range of 450 to 550° C. to alloy the hot-dip galvanizing layer (Fe content in the galvanizing layer: about 10%).

For the resultant hot-dip galvanized steel sheet, tensile properties were determined through a tensile test. In addition, test pieces were sampled from the hot-dip galvanized steel sheet, and a pre-deformation treatment with a tensile prestrain of 5% was applied to the test pieces, as in the hot-rolled steel sheet and the cold-rolled steel sheet. Then, a heat treatment of 50 to 350° C. for 20 minutes was applied. Thereafter, a tensile test was carried out to determine tensile properties. The strain age hardenability was evaluated in terms of the increment ΔTS of the tensile strength from before to after the heat treatment.

FIG. 5 illustrates the effect of the Cu content on the relationship between ΔTS and the secondary heat treatment temperature. The increment ΔTS was determined by applying a tensile prestrain of 5% to test pieces sampled from the resultant hot-dip galvanized steel sheets, conducting a heat treatment at 250° C. for 20 minutes, and carrying out a tensile test.

FIG. 5 suggests that, for a Cu content of 1.3 wt. %, a high strain age hardenability as represented by a ΔTS of not less than 80 MPa can be obtained by forming a composite ferrite/tempered martensite/retained austenite steel sheet structure. In contrast, in the case of a Cu content of 0.3 wt. %, high strain age hardenability cannot be obtained as because ΔTS is less than 80 MPa at any secondary heat treatment temperature.

FIG. 5 suggests the possibility of manufacturing a hot-dip galvanized steel sheet having high strain age hardenability by optimizing the Cu content and by forming a composite ferrite/tempered martensite/retained austenite structure.

FIG. 6 illustrates the effect of the Cu content on the relationship between ΔTS and the heat treatment temperature after pre-strain treatment. The increment ΔTS was determined by applying a tensile prestrain of 5% to test pieces sampled from the alloyed hot-dip galvanized steel sheets treated at a secondary heat treatment temperature of 800° C., conducting a heat treatment of 50 to 350° C. for 20 minutes, and carrying out a tensile test.

FIG. 6 shows that the increment ΔTS increases as the heat treatment temperature increases after the pre-deformation treatment and strongly depends on the Cu content. With a Cu content of 1.3 wt. %, a high strain age hardenability as represented by a ΔTS of not less than 80 MPa can be obtained at a heat treatment temperature of not less than 150° C. In contrast, for a Cu content of 0.3 wt. %, ΔTS is less than 80 MPa at any heat treatment temperature, and high strain age hardenability cannot be obtained.

In the hot-dip galvanized steel sheet of the present invention, very fine Cu precipitates in the steel sheet as a result of a pre-deformation with a strain larger than 2% which is a usual amount of strain on measuring the deformation stress increment from before to after a heat treatment, and a heat treatment within a relatively low temperature region of 150 to 350° C. According to a study carried out by the present inventors, high strain age hardenability bringing about an increase in yield stress and a remarkable increase in tensile strength is probably achieved by the precipitation of very fine Cu. A reason for precipitation of very fine Cu in a heat treatment in a low temperature region has not as yet been clarified to date. However, it is presumable as follows. During heat treatment in the dual phase region of ferrite (α)+austenite (γ), a large amount of Cu is distributed to the γ phase, and the distributed Cu remaining even after cooling is dissolved into the retained austenite in a supersaturation state. The retained austenite is transformed into martensite by a prestrain of not less than 5%, and very fine Cu precipitates in the martensite through a subsequent low-temperature heat treatment.

In addition, hole expanding test was performed using hot-dip galvanized steel sheets having a composite structure of ferrite/tempered martensite/retained austenite and Cu contents of 0.3 wt % and 1.3 wt. % to determine the hole expanding ratio (λ), as in the hot-rolled steel sheet and the cold-rolled steel sheet.

The hole expanding ratio λ of the steel sheet having a Cu content of 1.3% was 120%, while the hole expanding ratio λ of the steel sheet having a Cu content of 0.3% was 50%. The results suggest that for a Cu content of 1.3 wt %, the hole expanding ratio is increased and hole expanding formability is improved, as compared with a Cu content of 0.3%.

A detailed mechanism of improvement in hole expanding formability with content of Cu has not yet been clarified, as in the hot-rolled steel sheet and the cold-rolled steel sheet, but it is considered that the contained Cu reduces the difference in hardness among the ferrite, the tempered martensite/retained austenite, and the martensite formed by strain induced transformation.

On the basis of the novel findings as described above, the present inventors carried out further extensive studies and found that the above-mentioned phenomena occurred in steel sheets not containing Cu as well.

The structure of a steel sheet having a composition containing at least one of Mo, Cr, and W was converted to a composite structure containing a ferrite primary phase and a phase containing retained austenite as a secondary phase. Thereafter, by applying a prestrain and a heat treatment in a low temperature region, it was found that very fine carbides precipitated in the strain-induced transformed martensite, resulting in an increase in tensile strength. The strain-induced fine precipitation at a low temperature was more remarkable in a steel composition containing at least one of Nb, Ti, and V in addition to at least one of Mo, Cr, and W.

The present invention was completed through further studies on the basis of the aforementioned findings. The gist of the present invention is as follows:

(1) A high-ductility steel sheet excellent in press formability and in strain age hardenability as represented by a ΔTS of not less than 80 MPa, comprising a composite structure containing a primary phase containing a ferrite phase and a secondary phase containing a retained austenite phase in a volume ratio of not less than 1%.

(2) A high-ductility steel sheet according to aspect (1), wherein the steel sheet is a hot-rolled steel sheet, and the primary phase consisting essentially of a ferrite phase.

(3) A high-ductility steel sheet according to aspect (2), wherein the hot-rolled steel sheet has a composition comprising, in weight percent, C: 0.05 to 0.20%, Si: 1.0 to 3.0%, Mn: not more than 3.0%, P: not more than 0.10%, S: not more than 0.02%, Al: not more than 0.30%, N: not more than 0.02%, and Cu: 0.5 to 3.0%, and the balance Fe and incidental impurities.

(4) A high-ductility steel sheet according to aspect (3), the composition further comprising, in weight percent, at least one of the following Groups A to C:

Group A: Ni: not more than 2.0%;

Group B: at least one of Cr and Mo: not more than 2.0% in total; and

Group C: at least one of Nb, Ti, and V: not more than 0.2% in total.

(5) A high-ductility steel sheet according to aspect (2), wherein the hot-rolled steel sheet has a composition comprising, in weight percent, C: 0.05 to 0.20%, Si: 1.0 to 3.0%, Mn: not more than 3.0%, P: not more than 0.10%, S: not more than 0.02%, Al: not more than 0.30%, N: not more than 0.02%, at least one of Mo: 0.05 to 2.0%, Cr: 0.05 to 2.0% and W: 0.05 to 2.0%, not more than 2.0% in total, and the balance Fe and incidental impurities.

(6) A high-ductility steel sheet according to aspect (5), the composition further containing, in weight percent, at least one of Nb, Ti, and V in an amount of not more than 2.0% in total.

(7) A method for manufacturing a high-ductility hot-rolled steel sheet excellent in press formability and in strain age hardenability as represented by a ΔTS of not less than 80 MPa, comprising the steps of: hot-rolling a steel slab having a composition comprising, in weight percent, C: not more than 0.20%, Si: 1.0 to 3.0%, Mn: not more than 3.0%, P: not more than 0.10%, S: not more than 0.02%, Al: not more than 0.30%, N: not more than 0.02%, and Cu: 0.5 to 3.0%, into a hot-rolled steel sheet having a prescribed thickness, the hot rolling step including finish-rolling at a finish rolling end temperature of 780 to 980° C.; cooling the finish-rolled steel sheet to a temperature in the range of 620 to 780° C. within 2 seconds at a cooling rate of at least 50° C./second; holding the sheet at the temperature in the range of 620 to 780° C. for 1 to 10 seconds, or slowly cooling the sheet at a cooling rate of not more than 20° C./second; cooling the sheet at a cooling rate of not less than 50° C./second to a temperature of 300 to 500° C.; and coiling the sheet.

(8) A method for manufacturing a high-ductility hot-rolled steel sheet excellent in press formability and in strain age hardenability as represented by a ΔTS of at least 80 MPa, according to aspect (7), the composition further comprising, in weight percent, at least one of the following Groups A to C:

Group A: Ni: not more than 2.0%;

Group B: at least one of Cr and Mo: not more than 2.0% in total; and

Group C: at least one of Nb, Ti, and V: not more than 0.2% in total.

(9) A method for manufacturing a high-ductility hot-rolled steel sheet according to aspect (7), wherein the steel slab is replaced with a steel slab having a composition containing, in weight percent, C: 0.05 to 0.20%, Si: 1.0 to 3.0%, Mn: not more than 3.0%, P: not more than 0.10%, S: not more than 0.02%, Al: not more than 0.30%, N: not more than 0.02%, and at least one of Mo: 0.05 to 2.0%, Cr: 0.05 to 2.0% and W: 0.05 to 2.0% in a total amount of not more than 2.0%.

(10) A method for manufacturing a high-ductility hot-rolled steel sheet according to aspect (9), the composition further containing, in weight percent, at least one of Nb, Ti, and V in a total amount of not more than 2.0%.

(11) A method for manufacturing a high-ductility hot-rolled steel sheet according to any one of aspects (7) to (10), wherein all or part of the finish rolling is lubrication rolling.

(12) A high-ductility steel sheet according to aspect (1), wherein the steel sheet is a cold-rolled steel sheet, and the primary phase containing the ferrite phase is a ferrite phase.

(13) A high-ductility steel sheet according to aspect (12), wherein the cold-rolled steel sheet has a composition comprising, in weight percent, C: not more than 0.20%, Si: not more than 2.0%, Mn: not more than 3.0%, P: not more than 0.1%, S: not more than 0.02%, Al: not more than 0.3%, N: not more than 0.02%, Cu: 0.5 to 3.0%, and the balance Fe and incidental impurities.

(14) A high-ductility steel sheet according to aspect (13), the composition further comprising, in weight percent, at least one of the following Groups A to C:

Group A: Ni: not more than 2.0%;

Group B: at least one of Cr and Mo: not more than 2.0% in total; and

Group C: at least one of Nb, Ti, and V: not more than 0.2% in total.

(15) A high-ductility steel sheet according to aspect (12), wherein the cold-rolled steel sheet has a composition comprising, in weight percent: C: not more than 0.20%, Si: not more than 2.0%, Mn: not more than 3.0%, P: not more than 0.1%, S: not more than 0.02%, Al: not more than 0.3%, N: not more than 0.02%, at least one selected from the group consisting of Mo: 0.05 to 2.0%, Cr: 0.05 to 2.0% and W: 0.05 to 2.0%, not more than 2.0% in total, and the balance Fe and incidental impurities.

(16) A high-ductility steel sheet according to aspect (15), the composition further comprising, in weight percent, at least one of Nb, Ti, and V, in a total amount of not more than 2.0%.

(17) A method for manufacturing a high-ductility cold-rolled steel sheet excellent in press formability and in strain age hardenability as represented by a ΔTS of not less than 80 MPa, comprising: a hot rolling step of hot-rolling a steel slab having a composition containing, in weight percent, C: not more than 0.20%, Si: not more than 2.0%, Mn: not more than 3.0%, P: not more than 0.1%, S: not more than 0.02%, Al: not more than 0.3%, N: not more than 0.02%, and Cu: 0.5 to 3.0% as a material to form a hot-rolled steel sheet; a cold rolling step of cold-rolling the hot-rolled steel sheet into a cold-rolled steel sheet; and a recrystallization annealing step of applying recrystallization annealing to the cold-rolled steel sheet into a cold-rolled annealed steel sheet, the recrystallization annealing step including a heat treatment of heating and soaking the steel sheet in a ferrite/austenite dual phase region within a temperature range of the $A_{C1}$ transformation point to the $A_{C3}$ transformation point, cooling the sheet, and holding the sheet in the temperature region of 300 to 500° C. for 30 to 1,200 seconds.

(18) A method for manufacturing a high-ductility cold-rolled steel sheet according to aspect (17), the composition further containing, in weight percent, at least one selected from the following Groups A to C:

Group A: Ni: not more than 2.0%;

Group B: at least one of Cr and Mo: not more than 2.0% in total; and

Group C: at least one of Nb, Ti, and V: not more than 0.2% in total.

(19) A method for manufacturing a high-ductility cold-rolled steel sheet according to aspect (17), wherein the steel slab is replaced with a steel slab having a composition containing, in weight percent, C: not more than 0.20%, Si: not more than 2.0%, Mn: not more than 3.0%, P: not more than 0.10%, S: not more than 0.02%, Al: not more than 0.3%, N: not more than 0.02%, and at least one selected from the group consisting of Mo: 0.05 to 2.0%, Cr: 0.05 to 2.0% and W: 0.05 to 2.0% in a total amount of not more than 2.0%.

(20) A method of manufacturing a high-ductility cold-rolled steel sheet according to aspect (19), the composition further containing, in weight percent, at least one of Nb, Ti, and V in a total amount of not more than 2.0%.

(21) A method for manufacturing a high-ductility cold-rolled steel sheet according to any one of aspects (17) to (20), wherein the hot-rolling step includes heating the steel slab at a temperature of not less than 900° C., rolling the slab at a finish rolling end temperature of not less than 700° C., and coiling the hot-rolled steel sheet at a coiling temperature of not more than 800° C.

(22) A method for manufacturing a cold-rolled steel sheet according to any one of aspects (17) to (21), wherein all or part of the hot rolling is lubrication rolling.

(23) A high-ductility hot-dip galvanized steel sheet comprising a hot-dip galvanizing layer or an alloyed hot-dip galvanizing layer formed on the surface of the high-ductility steel sheet according to any one of aspects (1) to (6).

(24) A high-ductility hot-dip galvanized steel sheet comprising a hot-dip galvanizing layer or an alloyed hot-dip galvanizing layer formed on the surface of the high-ductility steel sheet according to any one of aspects (12) to (16).

(25) A high-ductility steel sheet according to aspect (1), wherein the steel sheet is a hot-dip galvanized steel sheet having a hot-dip galvanizing layer or an alloyed hot-dip galvanizing layer formed on a surface of the steel sheet, and the primary phase containing a ferrite phase comprises a ferrite phase and a tempered martensite phase.

(26) A high-ductility steel sheet according to aspect (25), wherein the steel sheet has a composition comprising, in weight percent, C: not more than 0.20%, Si: not more than 2.0%, Mn: not more than 3.0%, P: not more than 0.1%, S: not more than 0.02%, Al: not more than 0.3%, N: not more than 0.02%, Cu: 0.5 to 3.0%, and the balance Fe and incidental impurities.

(27) A high-ductility steel sheet according to aspect (26), the composition further containing, in weight percent, at least one of the following Groups A to C:

Group A: Ni: not more than 2.0%;

Group B: at least one of Cr and Mo: not more than 2.0% in total; and

Group C: at least one of Nb, Ti, and V: not more than 0.2% in total.

(28) A high-ductility steel sheet according to aspect (25), wherein the steel sheet has a composition comprising, in weight percent, C: not more than 0.20%, Si: not more than 2.0%, Mn: not more than 3.0%, P: not more than 0.1%, S: not more than 0.02%, Al: not more than 0.3%, N: not more than 0.02%, at least one selected from the group consisting of Mo: 0.05 to 2.0%, Cr: 0.05 to 2.0% and W: 0.05 to 2.0% in a total amount of not more than 2.0%, and the balance Fe and incidental impurities.

(29) A high-ductility steel sheet according to aspect (28), the composition further containing, in weight percent, at least one of Nb, Ti, and V in a total amount of not more than 2.0%.

(30) A method for manufacturing of a high-ductility hot-dip galvanized steel sheet excellent in press formability and in strain age hardenability as represented by a ΔTS of not less than 80 MPa, comprising: a primary heat-treating step of heating a steel sheet to a temperature of not less than the $A_{C1}$ transformation point and rapidly cooling the steel sheet, the steel sheet having a composition containing, in weight percent, C: not more than 0.20%, Si: not more than 2.0%, Mn: not more than 3.0%, P: not more than 0.1%, S: not more than 0.02%, Al: not more than 0.3%, N: not more than 0.02%, and Cu: 0.5 to 3.0%; a secondary heat-treating step of heating the steel sheet to a temperature in the range of the $A_{C1}$ transformation point to the $A_{C3}$ transformation point; and a hot-dip galvanizing step of forming a hot-dip galvanizing layer on the surface of the steel sheet.

(31) A method for manufacturing a high-ductility cold-rolled steel sheet according to aspect (30), the composition further containing, in weight percent, at least one of the following Groups A to C:

Group A: Ni: not more than 2.0%;

Group B: at least one of Cr and Mo: not more than 2.0% in total; and

Group C: at least one of Nb, Ti, and V: not more than 0.2% in total.

(32) A method for manufacturing a high-ductility hot-dip galvanized steel according to aspect (30), wherein the steel sheet is replaced with a steel sheet having a composition comprising, in weight percent, C: not more than 0.20%, Si: not more than 2.0%, Mn: not more than 3.0%, P: not more than 0.1%, S: not more than 0.02%, Al: not more than 0.3%, N: not more than 0.02%, and at least one selected from the group consisting of Mo: 0.05 to 2.0%, Cr: 0.05 to 2.0% and W: 0.05 to 2.0% in a total amount of not more than 2.0%.

(33) A method for manufacturing a high-ductility hot-dip galvanized steel sheet according to aspect (32), the composition further containing, in weight percent, at least one of Nb, Ti, and V in a total amount of not more than 2.0%.

(34) A method for manufacturing a high-ductility hot-dip galvanized steel sheet according to any one of aspects (30) to (33), further comprising a pickling treatment step of pickling the steel sheet between the primary heat-treating step and the secondary heat-treating step.

(35) A method for manufacturing a high-ductility hot-dip galvanized steel sheet according to any one of aspects (30) to (34), further comprising an alloying step of alloying the hot-dip galvanizing layer, subsequent to the hot-dip galvanizing step.

(36) A method for manufacturing a high-strength hot-dip galvanized steel sheet according to any one of aspects (30) to (35), wherein the steel sheet is a hot rolled steel sheet manufactured by hot-rolling a material under conditions including a heating temperature of not less than 900° C., a finish rolling end temperature of not less than 700° C. and a coiling temperature of not more than 800° C., or a cold-rolled steel sheet obtained by cold-rolling the hot-rolled steel sheet.

(37) A method for manufacturing a high-strength hot-dip galvanized steel sheet according to aspect (36), wherein the cold-rolling is performed at a reduction ratio of not less than 40%.

DESCRIPTION OF THE PREFERRED EMBODIMENTS

Figure 1:
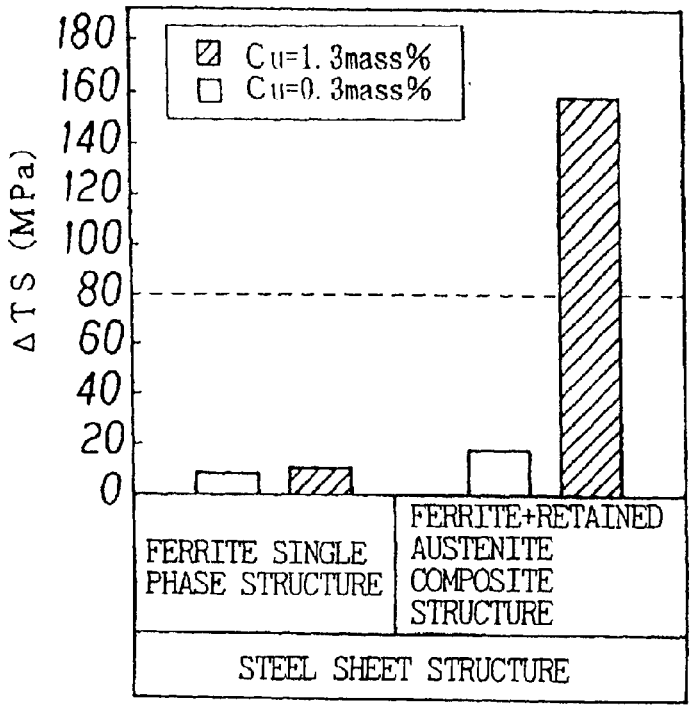
FIG. 1 is a graph illustrating the effect of the Cu content on the relationship between ΔTS and the steel sheet structure after a pre-deformation and a heat treatment of a hot-rolled steel sheet.
Figure 2:
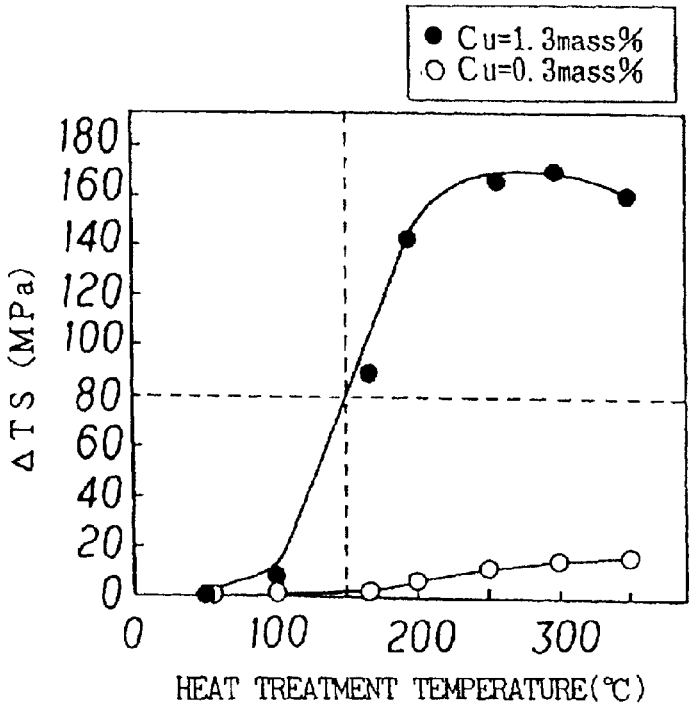
FIG. 2 is a graph illustrating the effect of the Cu content on the relationship between ΔTS and the heat treatment temperature after a pre-deformation and a heat treatment of a hot-rolled steel sheet.
Figure 3:
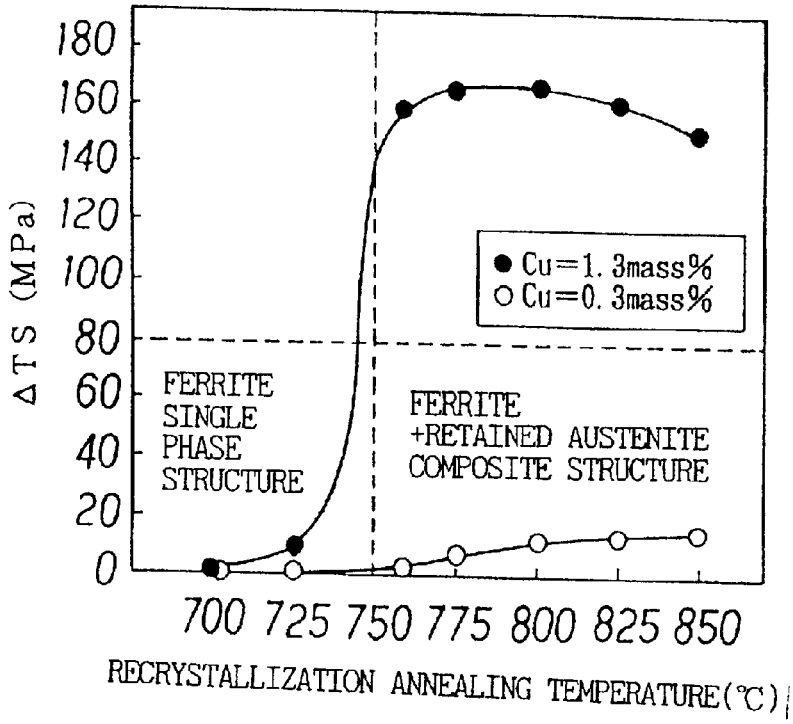
FIG. 3 is a graph illustrating the effect of the Cu content on the relationship between ΔTS and the recrystallization annealing temperature after pre-deformation and a heat treatment of a cold-rolled steel sheet.
Figure 4:
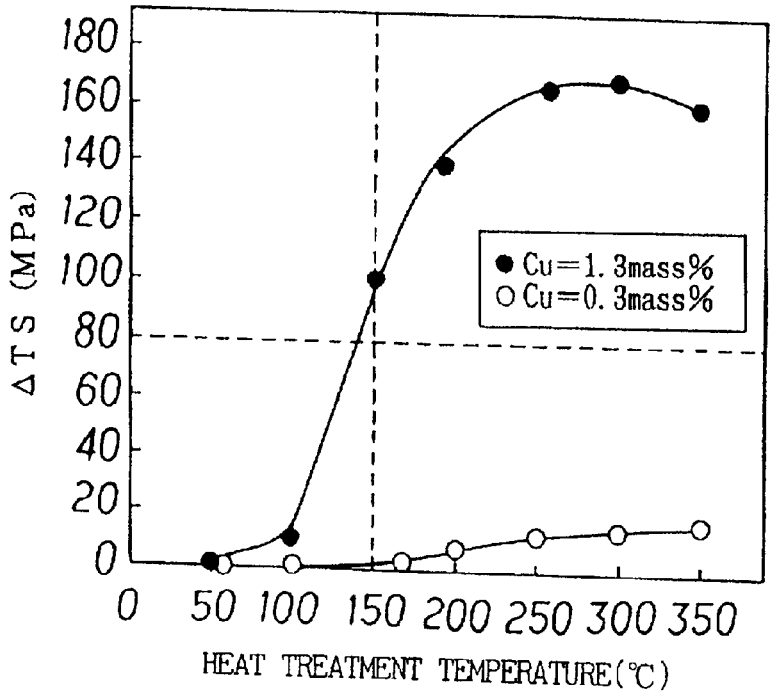
FIG. 4 is a graph illustrating the effect of the Cu content on the relationship between ΔTS and the heat treatment temperature after pre-deformation and a heat treatment of a cold-rolled steel sheet.
Figure 5:
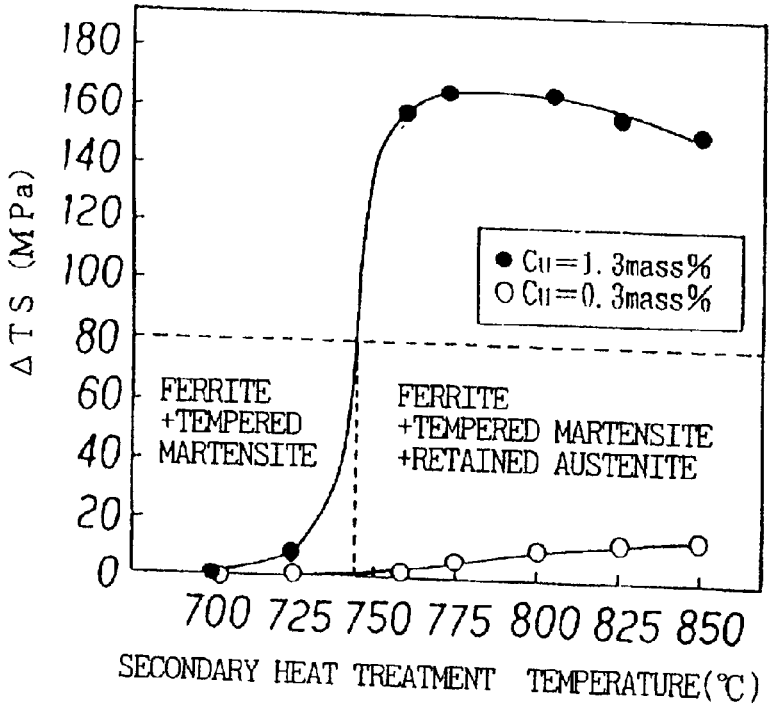
FIG. 5 is a graph illustrating the effect of the Cu content on the relationship between ΔTS and the secondary heat treatment temperature after a pre-deformation and a heat treatment of a hot-dip galvanized steel sheet.
Figure 6:
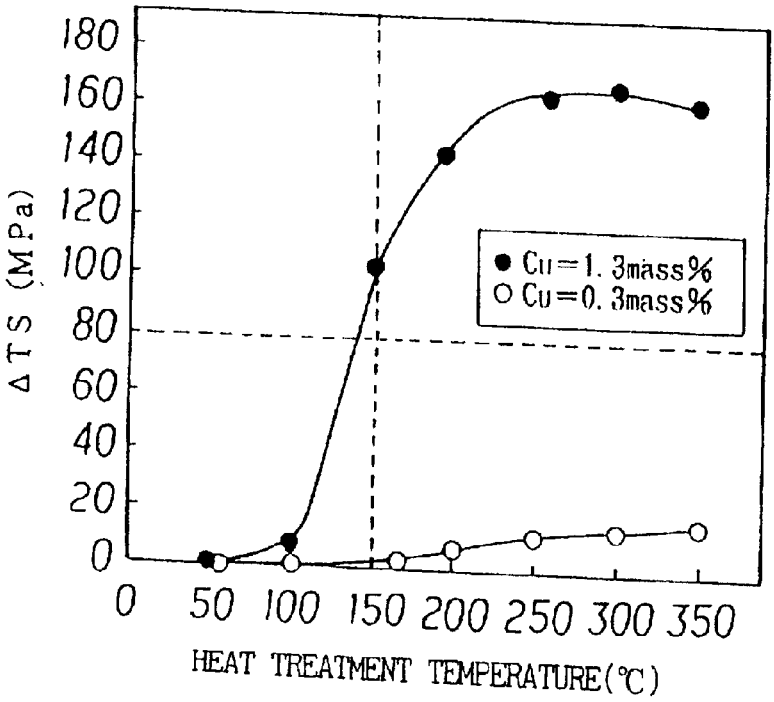
FIG. 6 is a graph illustrating the effect of the Cu content on the relationship between ΔTS and the heat treatment temperature after a pre-deformation and a heat treatment of a hot-dip galvanized steel sheet.

A high-ductility steel sheet of the present invention has a tensile strength TS of not less than 440 MPa, a composite structure comprising a primary phase containing a ferrite phase and a secondary phase containing a retained austenite phase with a volume ratio of not less than 1%, excellent press formability, and excellent strain age hardenability, which is indicated by a remarkably increased tensile strength ΔTS of not less than 80 MPa during a heat treatment at a relatively low temperature after press forming. The term "primary phase" used in the present invention shall be a structure occupying not less than 50% by a volume ratio.

The term "high-ductility steel sheet" used in the present invention shall mean that a steel sheet has a balance (TS×El) of a tensile strength (TS) and an elongation (El) of not less than 19,000 MPa %.

In addition, the term "ΔTS" used in the present invention means an increment in tensile strength between before and after the heat treatment at a temperature in the range of 150 to 350° C. for a holding time of not less than 30 seconds of a steel sheet which was subjected to a pre-deformation treatment of a tensile plastic strain of not less than 5%. That is, ΔTS=(tensile strength after heat treatment)−(tensile strength before pre-deformation treatment). The steel sheets of the present invention shall include hot-rolled steel sheets, cold-rolled steel sheets and hot-dip galvanized steel sheets.

All the steel sheets (hot-rolled steel sheets, cold-rolled steel sheets and hot-dip galvanized steel sheets) having the above-mentioned structure have high-ductility, excellent press formability, and excellent strain age hardenability.

The term "superior strain age hardenability" or the term "excellent strain age hardenability" used in the present invention shall mean that, when a steel sheet is subjected to a pre-deformation treatment of a tensile plastic strain of not less than 5%, and then, to a heat treatment at a temperature in the range of 150 to 350° C. for a holding time of not less than 30 seconds, the increment ΔTS in tensile strength between before and after the heat treatment is not less than 80 MPa, wherein ΔTS=(tensile strength $TS_{HT}$ after heat treatment)−(tensile strength TS before pre-deformation treatment). Preferably, the increment ΔTS is not less than 100 MPa. The heat treatment causes an increase ΔYS in yield stress of not less than 80 MPa, wherein ΔYS=(yield stress $YS_{HT}$ after heat treatment)−(yield stress YS before pre-deformation treatment).

In the control of the strain age hardenability, the amount of prestrain (pre-deformation) plays an important role. The present inventors investigated the effect of the amount of prestrain on the subsequent strain age hardenability by assuming possible deformation types applied to automotive steel sheets. The results show that the uniaxial equivalent strain (tensile strain) is generally useful for elucidating the deformation of the steel sheets except for very deep drawing, that the uniaxial equivalent strain is mostly more than 5% for actual parts, and that the strength of the parts exhibit good correspondence to the strength obtained after a strain aging treatment of a prestrain of 5%. Based on these findings, a tensile plastic strain of not less than 5% is employed in the present invention.

Conventional bake treatment conditions include 170° C.×20 minutes as a standard. If precipitation strengthening by very fine Cu or fine carbide is performed as in the present invention, the heat treatment temperature must be 150° C. or more. Under conditions including a temperature exceeding 350° C., on the other hand, the strengthening effect is saturated, and the steel sheet tends to soften. Heating to a temperature exceeding 350° C. causes marked occurrence of thermal strain or temper color. For these reasons, a heat treatment temperature in the range of 150 to 350° C. is adopted for strain age hardening in the present invention. The holding time of the heat treatment temperature should be at least 30 seconds. Holding a heat treatment temperature in the range of 150 to 350° C. for about 30 seconds permits achievement of substantially satisfactory strain age hardening. For further enhanced strain age hardening, the holding time is preferably at least 60 seconds, and more preferably at least 300 seconds.

The heat treatment method after the pre-deformation is not limited in the present invention, and atmospheric heating in a furnace in general bake treatment, induction heating, non-oxidizing flame heating, laser heating, and plasma heating are suitably applicable. So-called hot pressing for pressing a heated steel sheet is also very effective means in the present invention.

Next, the hot-rolled steel sheet, the cold-rolled steel sheet, and the hot-dip galvanized steel sheet in the present invention will be described individually.

(1) Hot-rolled Steel Sheet

The hot-rolled steel sheet of the present invention will now be described.

The hot-rolled steel sheet of the present invention has a composite structure comprising a ferrite primary phase and a secondary phase containing a retained austenite phase having a volume ratio of not less than 1% of the entire structure. As described above, a hot-rolled steel sheet having such a composite structure exhibits high ductility, high strength-ductility balance (TS×El), and excellent press formability.

Ferrite primary phase is preferably present in a volume ratio of not less than 50%. With a ferrite phase of less than 50%, it is difficult to keep high ductility, resulting in lower press formability. When further enhanced ductility is required, the volume ratio of the ferrite phase is preferably not less than 80%. For the purpose of making full use of advantages of the composite structure, the ferrite phase is preferably not more than 98%.

In the present invention, steel must contain retained austenite phase as the secondary phase in a volume ratio of not less than 1% of the entire structure. With a retained austenite phase of less than 1%, high elongation (El) cannot be obtained. To obtain higher elongation (El), the retained austenite phase content is preferably not less than 2% and more preferably not less than 3%.

The secondary phase may be a single retained austenite phase having a volume ratio of not less than 1%, or may be a mixture of a retained austenite phase of a volume ratio of not less than 1% and another phase, i.e., a pearlite phase, a bainite phase, and/or a martensite phase.

The reasons for limiting the composition of the hot-rolled steel sheet of the present invention will now be described. The weight percent in the composition will hereafter be denoted simply as %.

C: 0.05 to 0.20%

C is an element, which improves strength of a steel sheet and promotes the formation of a composite structure of ferrite and retained austenite, and is preferably contained in an amount of not less than 0.05% for forming the composite structure according to the present invention. A C content exceeding 0.20% causes an increase in proportions of carbides in steel, resulting in a decrease in ductility, and hence a decrease in press formability. A more serious problem is that a C content exceeding 0.20% leads to significant deterioration of spot weldability and arc weldability. For these reasons, the C content is limited within the range of 0.05 to 0.20% in the present invention. From the viewpoint of formability, the C content is preferably not more than 0.18%.

Si: 1.0 to 3.0%

Si is a useful strengthening element, which improves the strength of a steel sheet without a marked decrease in ductility of the steel sheet. In addition, Si is necessary for forming a retained austenite phase. To obtain these effects, Si is preferably contained in an amount of not less than 1.0% and more preferably not less than 1.2%. An Si content exceeding 3.0% leads to deterioration of press formability and degrades the surface quality. The Si content is therefore limited within the range of 1.0 to 3.0%.

Mn: not more than 3.0%

Mn is a useful element, which strengthens steel and prevents hot cracking caused by S, and is therefore contained in an amount according to the S content. These effects are particularly remarkable at an Mn content of not less than 0.5%. On the other hand, an Mn content exceeding 3.0% results in deterioration of press formability and weldability. The Mn content is therefore limited to not more than 3.0% in the present invention. More preferably, the Mn content is not less than 1.0%.

P: not more than 0.10%

P strengthens steel, and may be contained in an amount necessary for a desired strength. From the viewpoint of increasing the strength, P is preferably contained in an amount of not less than 0.005%. On the other hand, a P content exceeding 0.10% results in deterioration of press formability. The P content is therefore limited to not more than 0.10%. When superior press formability is required, the P content is preferably not more than 0.08%.

S: not more than 0.02%

S is an element, which is present as inclusions in a steel sheet and causes deterioration of ductility, formability, and particularly stretch flanging formability of the steel sheet, and it should be the lowest possible. A reduced S content of not more than 0.02% does not exert much adverse effect and therefore, the S content is limited to up to 0.02% in the present invention. When more excellent stretch flanging formability is required, the S content is preferably not more than 0.010%.

Al: not more than 0.30%

Al is a useful element, which is added as a deoxidizing element to steel, and improves cleanliness of steel. In addition, Al facilitates the formation of the retained austenite. These effects are particularly remarkable at an Al content of not less than 0.01%. The Al content exceeding 0.30% cannot give further effects, but causes deterioration of press formability. The Al content is therefore limited to not more than 0.30%. Preferably, the Al content is not more than 0.10%. The present invention does not exclude a steelmaking process based on deoxidation using a deoxidizer other than Al. For example, Ti deoxidation or Si deoxidation may be employed, and steel sheets produced by such deoxidation methods are also included in the scope of the present invention. In this case, addition of Ca or REM to molten steel does not impair the features of the steel sheet of the present invention at all.

N: not less than 0.02%

N is an element, which increases the strength of a steel sheet through solid solution strengthening or strain age hardening, and is preferably contained in an amount of not less than 0.0010% to obtain these effects. However, an N content exceeding 0.02% causes an increase in the content of nitrides in the steel sheet, which causes serious deterioration of ductility, and thus, of press formability of the steel sheet. The N content is therefore limited to not more than 0.02%. When further improvement in press formability is required, the N content is preferably not more than 0.01%, and more preferably less than 0.0050%.

Cu: 0.5 to 3.0%

Cu is an element, which remarkably increases strain age hardening of a steel sheet (increase in strength after pre-deformation/heat treatment), and thus is most important in the present invention. With a Cu content of less than 0.5%, an increment ΔTS in tensile strength exceeding 80 MPa cannot be obtained by changing the pre-determination/heat treatment conditions. With a Cu content exceeding 3.0%, the effect is saturated so that an effect corresponding to the content cannot be expected, leading to unfavorable economic effects. Furthermore, deterioration of press formability occurs, and the surface quality of the steel sheet is degraded. The Cu content is therefore limited within a range of 0.5 to 3.0%. In order to simultaneously achieve a higher ΔTS and excellent press formability, the Cu content is preferably within a range of 1.0 to 2.5%.

The hot-rolled steel sheet of the present invention containing Cu preferably further contains, in weight percent, at least one of the following Groups A to C:

Group A: Ni: not more than 2.0%;

Group B: at least one of Cr and Mo: not more than 2.0% in total; and

Group C: at least one of Nb, Ti, and V: not more than 0.2% in total.

Group A: Ni: not more than 2.0%

Group A: Ni is effective for preventing the formation of surface defects on the steel sheet surface containing Cu, and may be added as required. The Ni content is preferably about a half the Cu content, i.e., in the range of about 30 to about 80% of the Cu content. An Ni content exceeding 2.0% cannot give further enhancement in the effect because saturation of the effect, leading to economic disadvantages, and causes deterioration of press formability. For these reasons, the Ni content is preferably limited to not more than 2.0%.

Group B: at least one of Cr and Mo: not more than 2.0% in total

Group B: Both Cr and Mo, as well as Mn, strengthen the steel sheet and at least one thereof can be contained as required. This effect is particularly remarkable at a Cr content of not less than 0.1% and at an Mo content of not less than 0.1%. It is therefore preferable to contain at least one of Cr: not less than 0.1% and Mo: not less than 0.1%. If at least one of Cr and Mo are contained in a total amount exceeding 2.0%, press formability is impaired. It is therefore preferable to limit the total content of Cr and Mo to not more than 2.0%.

Group C: at least one of Nb, Ti, and V: not more than 0.2% in total

Group C: Nb, Ti, and V are carbide-forming elements and effectively increase the strength by fine dispersion of carbides, and can be selected and contained as required. This effect can be achieved at an Nb content of not less than 0.01%, a Ti content of not less than 0.01%, and a V content of not less than 0.01%. However, a total content of Nb, Ti, and V exceeding 0.2% causes deterioration of press formability. Thus, the total content of Nb, Ti, and V is preferably limited to not more than 0.2%.

In the present invention, in place of the aforementioned Cu or at least one of the above-mentioned Groups A to C, at least one selected from the group consisting of Mo: 0.05 to 2.0%, Cr: 0.05 to 2.0%, and W: 0.05 to 2.0% may be contained in an amount of not more than 2.0% in total, and at least one selected from the group consisting of Nb, Ti, and V may be further contained in an amount of not more than 2.0% in total.

At least one selected from the group consisting of Mo: 0.05 to 2.0%, Cr: 0.05 to 2.0% and W: 0.05 to 2.0%, in an amount of not more than 2.0% in total Mo, Cr, and W are elements, which remarkably increase strain age hardening (increase in strength after pre-deformation and heat treatment) of a steel sheet, and are one of the most important elements in the present invention. That is, in the present invention, a hot-rolled steel sheet having a composite structure containing ferrite as a primary phase and a secondary phase of retained austenite and containing at least one of Mo, Cr, and W, causes strain-induced transformation of the retained austenite into martensite when a prestrain of not less than 5% and a low-temperature heat treatment are applied to the hot-rolled steel sheet, and strain-induced fine precipitation of fine carbides at a low temperature occurs in the strain-induced transformed martensite, resulting in an increase in tensile strength ΔTS of not less than 80 MPa. With a content of at least one of Mo, Cr, and W of less than 0.05%, changing the steel sheet structure and pre-deformation and heat treatment conditions does not cause an increase in tensile strength ΔTS of not less than 80 MPa. On the other hand, a content of at least one of Mo, Cr, and W exceeding 2.0% does not give a corresponding effect because of saturation of the effect, leading to economic disadvantages, and causes deterioration of press formability. The contents of Mo, Cr, and W are each preferably limited within the range of 0.05 to 2.0%. From the viewpoint of press formability, the total content of Mo, Cr and/or W is more preferably limited to not more than 2.0%.

At least one of Nb, Ti, and V, in a total amount of not more than 2.0%

Nb, Ti, and V are carbide-forming elements, and can be added as required. Containing at least one of Nb, Ti, and V, in addition to at least one of Mo, Cr, and W, and forming a composite structure containing a ferrite primary phase and a secondary phase of retained austenite form fine carbides in the strain-induced transformed martensite and cause strain-induced precipitation at low temperature, resulting in an increase in tensile strength ΔTS of not less than 80 MPa. In order to obtain these effects, an Nb content is preferably not less than 0.01%, a Ti content is preferably not less than 0.01%, and a V content is preferably not less than 0.01%, and at least one of Nb, Ti, and V can be added as required. However, a total content exceeding 2.0% causes deterioration of press formability. Thus, the total content of Nb, Ti, and V is preferably limited to not more than 2.0%.

Apart from the above-mentioned elements, at least one of Ca: not less than 0.1% and REM: not less than 0.1% may be contained. Ca and REM are elements contributing to improvement in stretch flanging property through conformational control of inclusions. If the Ca content exceeds 0.1% or the REM content exceeds 0.1%, however, there would be a decrease in cleanliness, and a decrease in ductility.

The balance of the composition of the steel sheet is Fe and incidental impurities. Allowable incidental impurities are Sb: not more than 0.01%, Sn: not more than 0.1%, Zn: not more than 0.01%, Co: not more than 0.1%, Zr: not more than 0.1%, and B: not more than 0.1%.

A method for manufacturing the hot-rolled steel sheet of the present invention will now be described.

The hot-rolled steel sheet of the present invention is made by hot-rolling a steel slab having a composition within the ranges described above into a prescribed thickness.

While the steel slab used is preferably manufactured by a continuous casting process to prevent macro-segregation of the constituents, it may be manufactured by an ingot casting process or a thin-slab casting process. A conventional process employed in this embodiment includes the steps of manufacturing a steel slab, cooling the steel slab to room temperature, and reheating the slab. Alternatively, an energy-saving process also is applicable without problem in the present invention. For example, a hot steel slab is charged into a heating furnace without cooling to room temperature, or directly rolled immediately after short temperature holding(direct-hot-charge rolling or direct rolling).

The reheating temperature SRT of the material (steel slab) is not limited and is preferably not less than 900° C.

Slab reheating temperature: not less than 900° C.

The slab reheating temperature (SRT) is preferably the lowest possible with a view to prevent surface defects caused by Cu when the material contains Cu. However, with a reheating temperature of less than 900° C., there is an increase in the rolling load, thus increasing the risk of occurrence of a trouble during hot rolling. Considering the increase in scale loss caused along with accelerated oxidation, the slab reheating temperature is preferably not more than 1,300° C.

From the viewpoint of reducing the slab reheating temperature and preventing occurrence of troubles during hot rolling, use of a so-called sheet bar heater heating a sheet bar is of course an effective method.

The reheated steel slab is then hot-rolled into a hot-rolled sheet. In the present invention, a finish rolling condition is particularly important, and the hot rolling is preferably performed at a finish rolling end temperature (FDT) in the range of 780 to 980° C.

At the FDT of less than 780° C., a deformed structure remains in the steel sheet to cause deterioration of ductility. On the other hand, an FDT exceeding 980° C. coarsens the structure, leading to a decrease in formability due to delay of ferrite transformation. Thus, the FDT is preferably in the range of 780 to 980° C.

After the completion of finish rolling, a forced cooling treatment is applied. In the present invention, a forced cooling condition is particularly important. In the present invention, within 2 seconds after the completion of finish rolling, a forced cooling is preferably carried out at a cooling rate of not less than 50° C./second to a temperature in the range of 620 to 780° C. With a cooling start time exceeding 2 seconds, the structure coarsens and ferrite transformation is delayed, resulting in poor press formability. The cooling start time after the completion of finish rolling is preferably limited to within 2 seconds.

With a cooling rate of less than 50° C./second after the completion of finish rolling, and ferrite transformation undesirably starts during the forced cooling, ferrite transformation does not appropriately occur in a subsequent isothermal holding treatment or slow cooling treatment, thus resulting in a decreased press formability. Accordingly, the cooling rate is preferably limited to not less than 50° C./second. However, with a cooling rate exceeding 300° C./second, degradation of the steel sheet shape is concerned. Thus, the upper limit of the cooling rate is preferably 300° C./second.

In addition, in the present invention, the steel sheet is preferably cooled to the vicinity of a nose of a free or pro-eutectoid ferrite temperature region of 620 to 780° C. by the above-mentioned forced cooling. At a cooling stop temperature of less than 620° C. of the forced cooling, free ferrite is not generated, but pearlite is generated. At a cooling stop temperature exceeding 780° C., a decrease in concentration of carbon into austenite decreases with a decrease in the generation of free ferrite. The cooling stop temperature of forced cooling is more preferably in the range of 650 to 750° C.

After the forced cooling to the vicinity of a nose of free ferrite temperature region of 620 to 780° C., an isothermal holding treatment for 1 to 10 seconds within the above-mentioned temperature region or a slow cooling treatment at a cooling rate of not more than 20° C./second is preferably performed.

By the isothermal holding treatment for a short period of time within this temperature region (620 to 780° C.) or the slow cooling treatment for a short period of time within the above-mentioned temperature region, a desired amount of free ferrite can be formed.

For achieving the concentration of carbon into the austenite along with ferrite transformation, the isothermal holding treatment or slow cooling treatment is more preferably performed within a temperature region of 620° C. to 750° C.

A holding time of the isothermal treatment or a time required for the slow cooling treatment of less than 1 second causes insufficient concentration of carbon into the austenite. On the other hand, a time exceeding 10 seconds causes pearlite transformation.

A cooling rate of the slow cooling treatment exceeding 20° C./second causes insufficient concentration of carbon into the austenite.

After the isothermal holding treatment or slow cooling treatment, the rolled sheet is preferably cooled again to a temperature of 300 to 500° C. at a cooling rate of not less than 50° C./second, and then coiled. That is, the rolled sheet is preferably coiled at a coiling temperature (CT) of 300 to 500° C.

After the isothermal holding treatment or slow cooling treatment, the rolled sheet is cooled to a temperature of 300 to 500° C. Also, the cooling rate of this treatment is preferably not less than 50° C./second. With the cooling rate of less than 50° C./second, pearlite transformation occurs and ductility is decreased. The cooling rate is more preferably within the range of 50 to 200° C./second.

With a coiling temperature CT of less than 300° C., the secondary phase contains martensite. On the other hand, with the coiling temperature exceeding 500° C., the secondary phase contains pearlite. Thus, the coiling temperature CT is preferably within a range of 300 to 500° C.

In the present invention, all or part of finish rolling may be lubrication rolling to reduce the rolling load during hot rolling. Application of lubrication rolling is effective also from the viewpoint of achieving a uniform steel sheet shape and uniform material quality. The frictional coefficient on the lubrication rolling is preferably in the range of 0.25 to 0.10. A continuous rolling process is preferable one,in which neighboring sheet bars can be connected to each other to perform finish rolling continuously. Application of the continuous rolling process is desirable also from the viewpoint of operational stability of hot rolling.

After the completion of hot rolling, temper rolling of not more than 10% may be applied for adjustment such as shape correction or surface roughness control.

The hot-rolled steel sheet of the invention may be used as a steel sheet for processing and as a steel sheet for surface treatments. Surface treatments include galvanizing (including alloying), tin-plating and enameling. After annealing or galvanizing, the hot-rolled steel sheet of the present invention may be subjected to a special treatment to improve activity to chemical treatment, weldability, press formability, and corrosion resistance.

(2) Cold-rolled Steel Sheet

A cold-rolled steel sheet of the present invention will now be described.

The cold-rolled steel sheet of the present invention has a composite structure comprising a ferrite primary phase and a secondary phase containing retained austenite having a volume ratio of not less than 1% of the entire structure. As described above, a cold-rolled steel sheet having such a composite structure exhibits high elongation (El), high strength/elongation balance (TS×El), and excellent press formability.

The volume ratio of the ferrite primary phase contained in the composite structure is preferably not less than 50%. With a ferrite phase content of less than 50%, it is difficult to keep high ductility, resulting in poor press formability. When further enhanced ductility is required, the volume ratio of the ferrite phase is preferably not less than 80%. For the purpose of making full use of advantages of the composite structure, the ferrite phase is preferably not more than 98%.

In the present invention, the steel sheet must contain a retained austenite phase as the secondary phase in a volume ratio of not less than 1% of the entire structure. With a retained austenite phase content of less than 1%, it is impossible to obtain high elongation (El). To obtain higher elongation (El), the retained austenite phase is preferably contained in a volume ratio of not less than 2%, more preferably, not less than 3%.

The secondary phase may be a single retained austenite phase having a volume ratio of not less than 1%, or may be a mixture of a retained austenite phase of a volume ratio of not less than 1% and an auxiliary (another) phase comprising a pearlite phase, a bainite phase, and/or a martensite phase.

The reasons for limiting the composition of the cold-rolled steel sheet of the present invention will now be described. The weight percent in the composition will simply be denoted hereinafter as %.

C: not more than 0.20%

C is an element, which improves strength of a steel sheet and promotes the formation of a composite structure of a ferrite phase and a retained austenite phase, and is preferably contained in an amount of not less than 0.01% from the viewpoint of forming the retained austenite phase in the present invention. A C content is more preferably not less than 0.05%. A C content exceeding 0.20%, however, causes an increase in amount of carbides in the steel, resulting in a decrease in ductility, and hence a decrease in press formability. A more serious problem is that a C content exceeding 0.20% leads to remarkable deterioration of spot weldability and arc weldability. For these reasons, in the present invention, the C content is limited to not more than 0.20%. From the viewpoint of formability, the C content is preferably not more than 0.18%.

Si: not more than 2.0%

Si is a useful strengthening element, which improves strength of a steel sheet without a marked decrease in ductility of the steel sheet and facilitates the formation of a residual austenite phase. The Si content is preferably not less than 0.1%. An Si content exceeding 2.0%, however, leads to deterioration of press formability and degrades the surface quality. The Si content is, therefore, limited to not more than 2.0%.

Mn: not more than 3.0%

Mn is a useful element, which strengthens the steel and prevents hot cracking caused by S, and is therefore contained in an amount according to the S content. These effects are particularly remarkable at an Mn content of not less than 0.5%. However, an Mn content exceeding 3.0% results in deterioration of press formability and weldability. The Mn content is, therefore, limited to not more than 3.0% in the present invention. More preferably, the Mn content is not less than 1.0%.

P: not more than 0.10%

P strengthens the steel, and may be contained in an amount of preferably not less than 0.005%, according to a desired strength. However, an excess P content causes deterioration of press formability. The P content is, therefore, limited to not more than 0.10%. When more excellent press formability is required, the P content is preferably not more than 0.08%.

S: not more than 0.02%

S is an element, which is present as inclusions in steel and causes deterioration of ductility, formability, and particularly stretch flanging formability of a steel sheet, and it should be the lowest possible. However, an S content reduced to not more than 0.02% does not exert much adverse effect. Thus, the S content is limited to not more than 0.02% in the present invention. When superior stretch flanging formability is required, the S content is preferably not more than 0.010%.

Al: not more than 0.30%

Al is a deoxidizing element of steel, and is useful for improving cleanliness of the steel. In addition, Al is effective for the formation of the retained austenite. In order to obtain these effects, the Al content is preferably not less than 0.01%. However, an Al content exceeding 0.30% cannot give further enhanced deoxidizing effects, and causes deterioration of press formability. The Al content is, therefore, limited to not more than 0.30%. The invention also includes a steel making process using other deoxidizers, for example, Ti or Si, and steel sheets produced by such deoxidation methods are also included in the scope of the invention. In this case, addition of Ca or REM to molten steel does not impair the features of the steel sheet of the invention at all. Of course, steel sheets containing Ca or REM are included within the scope of the invention.

N: not more than 0.02%

N is an element, which increases strength of a steel sheet through solid solution strengthening or strain age hardening, and is preferably contained in an amount of not more than 0.001%. However, an N content exceeding 0.02% causes an increase in nitride content in the steel sheet, whereby ductility and press formability of the steel sheet are seriously deteriorated. The N content is therefore limited to not more than 0.02%. When further improvement of press formability is required, the N content is preferably not more than 0.01%.

Cu: 0.5 to 3.0%

Cu is an element, which remarkably increases strain age hardening of a steel sheet (increase in strength after predeformation/heat treatment), and is one of the most important elements in the present invention. With a Cu content of less than 0.5%, an increase in tensile strength ΔTS exceeding 80 MPa cannot be obtained by changing the predeformation/heat treatment conditions. In the present invention, therefore, Cu should be contained in an amount of not less than 0.5%. With a Cu content exceeding 3.0%, however, the effect is saturated, leading to unfavorable economic effects. Furthermore, deterioration of press formability occurs, and the surface quality of the steel sheet is degraded. The Cu content is, therefore, limited within the range of 0.5 to 3.0%. In order to simultaneously achieve a higher ΔTS and excellent press formability, the Cu content is preferably within the range of 1.0 to 2.5%.

In the present invention, the above-mentioned composition containing Cu preferably further contains, in weight percent, at least one of the following Groups A to C:

Group A: Ni: not more than 2.0%;

Group B: at least one of Cr and Mo: not more than 2.0% in total; and

Group C: at least one of Nb, Ti, and V: not more than 0.2% in total.

Group A: Ni: not more than 2.0%

Group A: Ni is an element effective for preventing surface defects produced by Cu contained in the steel sheet, and may be contained as required. The Ni content depends on the Cu content, and is preferably about a half the Cu content, more specifically, within the range of about 30 to about 80% of the Cu content. An Ni content exceeding 2.0% cannot give further enhancement in the effect because of saturation of the effect, leading to economic disadvantages, and causes deterioration of press formability. For these reasons, the Ni content is preferably limited to not more than 2.0%.

Group B: at least one of Cr and Mo: not more than 2.0% in total

Group B: Both Cr and Mo, as well as Mn, strengthen the steel sheet and may be contained as required preferably in an amount of not less than 0.1% for Cr and not less than 0.1% for Mo. If at least one of Cr and Mo are contained in an amount exceeding 2.0% in total, press formability is impaired. It is therefore preferable to limit the total content of Cr and Mo forming Group B to not more than 2.0%.

Group C: at least one of Nb, Ti, and V: not more than 0.2% in total

Group C: Nb, Ti, and V are elements, which effectively form fine dispersion of carbides contributing to an increase in strength. Therefore, Nb, Ti, and V can be selected and contained as required preferably in an amount of not less than 0.01% for Nb, in an amount of not less than 0.01% for Ti and in an amount of not less than 0.01% for V. If the total content of at least one of Nb, Ti, and V exceeds 0.2%, the press formability is impaired. Thus, the total content of Nb, Ti and/or V is preferably limited to not more than 0.2%.

In the present invention, in place of the aforementioned Cu, at least one selected from the group consisting of Mo: 0.05 to 2.0%, Cr: 0.05 to 2.0%, and W: 0.05 to 2.0% may be contained in an amount of not more than 2.0% in total.

At least one selected from the group consisting of Mo: 0.05 to 2.0%, Cr: 0.05 to 2.0% and W: 0.05 to 2.0%, in an amount of not more than 2.0% in total In the present invention, all of Mo, Cr, and W, as well as Cu, are the most important elements, which remarkably increase strain age hardening of the steel sheet, and can be selected and contained. When a steel sheet containing at least one of Mo, Cr, and W and having a composite structure of a ferrite phase and a phase containing retained austenite is subjected to a prestrain (pre-deformation) of not less than 5% and a low-temperature heat treatment (heat treatment), the retained austenite is changed into martensite by strain-induced transformation. Then, the formation of fine carbide precipitation in the martensite is induced by the strain, resulting in an increase in tensile strength ΔTS of not less than 80 MPa. With a content of each of these elements of less than 0.05%, changing pre-deformation/heat treatment conditions does not give an increase in tensile strength ΔTS of at least 80 MPa. If the content of each of these elements exceeds 2.0%, a further enhanced effect corresponding to the content cannot be expected as a result of saturation of the effect, leading to economic disadvantages, and this results in deterioration of press formability. The contents of Mo, Cr, and W are therefore limited within the range of 0.05 to 2.0% for Mo, 0.05 to 2.0% for Cr, and 0.05 to 2.0% for W. From the viewpoint of press formability, the total content of Mo, Cr, and W is limited to not more than 2.0%.

In the present invention, at least one selected from the group consisting of Mo, Cr, and W is preferably contained and further, at least one of Nb, Ti, and V are preferably contained not more than 2.0% in total.

At least one of Nb, Ti, and V, in a total amount of not more than 2.0%:

Nb, Ti, and V are elements forming carbides, and can be selected and contained as required, when at least one of Mo, Cr, and W is added. When the steel composition contains at least one of Mo, Cr, and W and has a composite structure containing a ferrite phase and a retained austenite phase, and contains at least one of Nb, Ti, and V, the retained austenite is transformed into martensite by strain-induced transformation during the pre-deformation/heat treatment. Then, fine carbide precipitation is induced by the strain in the martensite, thus resulting in an increase in tensile strength ΔTS of not less than 80 MPa. This effect is particularly remarkable preferably at a Nb content of not less than 0.01%, at a Ti content of not less than 0.01%, and at a V content of not less than 0.01%. However, a total content of Nb, Ti, and V exceeding 2.0% causes deterioration of press formability. Thus, the total content of Nb, Ti and/or V is preferably limited to not more than 2.0%.

Although no particular restriction is imposed, apart from the above-mentioned constituents, the composition may contain B: not more than 0.1%, Zr: not more than 0.1%, Ca: not more than 0.1%, and REM: not more than 0.1% without any problem.

The balance of the composition of the steel is Fe and incidental impurities. Allowable incidental impurities include Sb: not more than 0.01%, Sn: not more than 0.1%, Zn: not more than 0.01%, and Co: not more than 0.1%.

The method for manufacturing the cold-rolled steel sheet of the present invention will now be described.

The cold-rolled steel sheet of the present invention is manufactured through a hot rolling step of hot-rolling a steel slab having the composition within the aforementioned ranges into a hot-rolled steel sheet, a cold rolling step of cold-rolling the hot-rolled steel sheet into a cold-rolled steel sheet, and a recrystallization annealing step of recrystallization-annealing the cold-rolled steel sheet to form a cold-rolled annealed steel sheet.

Although the steel slab used is preferably manufactured by a continuous casting process to prevent macrosegregation of the constituents, it may be manufactured by an ingot casting process or a thin-slab continuous casting process. A conventional process employed in this embodiment includes the steps of manufacturing a steel slab, cooling the steel slab to room temperature, and reheating the slab. Alternatively, an energy-saving process is applicable without problem in the present invention. For example, a hot steel slab is charged into a reheating furnace without cooling to room temperature, or directly rolled immediately after short temperature holding (direct-feed rolling or direct rolling).

The steel slab having the above-mentioned composition is reheated and hot-rolled to make a hot-rolled steel sheet. No particular problem is encountered as to conventionally known conditions so far as such conditions permit manufacture of a hot-rolled steel sheet having a desired thickness in the hot rolling step. Preferable conditions for hot rolling are as follows:

Slab reheating temperature: not less than 900° C.

The slab reheating temperature is preferably the lowest possible with a view to prevent surface defects caused by Cu when the composition contains Cu. However, with a reheating temperature of less than 900° C., the rolling load increases, thus increasing the risk of occurrence of a trouble during hot rolling. In view of an increase in scale loss caused by facilitated oxidation, the slab reheating temperature is preferably not more than 1,300° C.

From the viewpoint of reducing the slab reheating temperature and preventing occurrence of troubles during hot rolling, use of a so-called sheet bar heater, which heats a sheet bar, is effective.

Finish rolling end temperature: not less than 700° C.

At a finish rolling end temperature (FDT) of not less than 700° C., it is possible to obtain a uniform hot-rolled mother sheet structure which can give an excellent formability after cold rolling and recrystallization annealing. A finish rolling end temperature of less than 700° C. leads to a non-uniform structure of the hot-rolled mother sheet and a higher rolling load during hot rolling, thus increasing the risk of occurrence of troubles during hot rolling. Thus, the FDT for the hot rolling step is preferably not less than 700° C.

Coiling temperature: not more than 800° C.

The coiling temperature is preferably not more than 800° C., and more preferably not less than 200° C. A coiling temperature exceeding 800° C. tends to cause a decrease in yield as a result of an increased scale loss. With a coiling temperature of less than 200° C., the steel sheet shape is seriously impaired, and there is an increasing risk of occurrence of inconveniences in practical use.

In the hot rolling step in the present invention, as described above, it is desirable to reheat the slab to a temperature of not less than 900° C., hot-roll the reheated slab at a finish rolling end temperature of not less than 700° C., and coil the hot-rolled steel sheet at a coiling temperature of not more than 800° C. and preferably not less than 200° C.

In the hot rolling step in the present invention, all or part of finish rolling may be lubrication rolling, which reduces the rolling load during the hot rolling. The lubrication rolling is effective also from the viewpoint of achieving a uniform steel sheet shape and a uniform material quality. The frictional coefficient on the lubrication rolling is preferably within a range of 0.25 to 0.10. It is desirable to connect neighboring sheet bars to each other to perform a continuous finish rolling process. Application of the continuous rolling process is desirable also from the viewpoint of operational stability of hot rolling.

Then, a cold rolling step is conducted for the hot-rolled steel sheet. In the cold rolling step, the hot-rolled steel sheet is cold-rolled into a cold-rolled steel sheet. Any cold rolling conditions may be used so far as such conditions permit production of cold-rolled steel sheets with desired dimensions and shape, and no particular restriction is imposed. The reduction in cold rolling is preferably not less than 40%. With a reduction of less than 40%, uniform recrystallization barely occurs during the subsequent recrystallization-annealing step.

Then, the cold-rolled steel sheet is subjected to the recrystallization annealing step to convert the sheet into a cold-rolled annealed steel sheet. The recrystallization annealing is preferably carried out on a continuous annealing line. In the present invention, the recrystallization annealing is a heat treatment which includes heating and soaking the cold-rolled sheet in the dual phase region of ferrite and austenite in the temperature range between the $A_{C1}$ transformation point and the $A_{C3}$ transformation point, cooling the sheet, and retaining the sheet at a temperature in the range of 300 to 500° C. for 30 to 1,200 seconds.

The heating and soaking temperature for recrystallization annealing is preferably within the dual phase region in the temperature range between the $A_{C1}$ transformation point and the $A_{C3}$ transformation point. The heating and soaking temperature of less than the $A_{C1}$ transformation point leads to the formation a single ferrite phase. On the other hand, a high temperature exceeding $A_{C3}$ transformation point results in coarsening of crystal grains, the formation of a single austenite phase, and a serious deterioration of press formability.

After the heating and soaking treatment, the sheet was cooled from the heating and soaking temperature and retained at a temperature in the range of 300 to 500° C. for 30 to 1,200 seconds. The heating and soaking treatment and the subsequent retaining treatment facilitates the formation of a retained austenite phase of not less than 1%. When the temperature for the retaining treatment is less than 300° C., the composite structure of ferrite and martensite is formed. On the other hand, a temperature range exceeding 500° C. leads to a ferrite/bainite composite structure or a ferrite/pearlite composite structure. In these cases, the retained austenite is barely formed.

In addition, a retention time of less than 30 seconds in the temperature range of 300 to 500° C. cannot lead to the formation of the retained austenite structure. Also, the retention time exceeding 1,200 seconds cannot lead to the formation of the retained austenite structure, but leads to a ferrite/bainite composite structure. Therefore, the retention time in the temperature region of 300 to 500° C. is preferably in the range of 30 to 1,200 seconds.

By the recrystallization annealing, a composite structure of a ferrite phase and a retained austenite phase is formed, whereby a high ΔTS can be obtained together with high ductility.

After the hot rolling, temper rolling with a reduction rate of not more than 10% may be applied for adjustments and other shape correction and, surface roughness control.

The cold-rolled steel sheet of the invention may be used as a steel sheet for processing and as a steel sheet for surface-treating. Surface treatments include galvanizing (including alloying), tin-plating and enameling. After galvanizing, the cold-rolled steel sheet of the present invention may be subjected to a special treatment to improve activity to chemical treatment, weldability, press formability, and corrosion resistance.

(3) Hot-dip Galvanized Steel Sheet

The hot-dip galvanized steel sheet of the present invention will now be described.

The hot-dip galvanized steel sheet of the present invention has a composite structure comprising a primary phase consisting of a ferrite phase and a tempered martensite phase and a secondary phase containing retained austenite phase in a volume ratio of not less than 2%.

Note that the term "tempered martensite phase" in the present invention means a phase produced by heating a lath martensite. That is, the tempered martensite phase still maintains a fine internal structure of the lath martensite, after the heating (tempering). Furthermore, the tempered martensite phase is softened by heating (tempering), has enhanced deformability as compared with martensite, and is effective for improving ductility of the steel sheet. Note that the term "lath martensite" means martensite consisting of bundles of thin long platelike martensite crystals, which can be observed with an electron microscope.

In the hot-dip galvanized steel sheet of the present invention, the total volume ratio of the ferrite phase and the tempered martensite phase functioning as the primary phase is preferably not less than 50%. With a total volume ratio of the ferrite phase and the tempered phase of less than 50%, it is difficult to secure high ductility and press formability is decreased. When further enhanced ductility is required, the total volume ratio of the ferrite phase and the martensite phase functioning as the primary phase is preferably not less than 80%. For the purpose of making full use of advantages of the composite structure, the total of the ferrite phase and the tempered martensite phase is preferably not more than 98%. The ferrite phase constituting the primary phase preferably occupies not less than 30% by volume of the entire structure, and the tempered martensite phase preferably occupies not less than 20% by volume of the entire structure. With a volume ratio of the ferrite phase of less than 30%, or with a volume ratio of the tempered martensite phase of less than 20%, the ductility will not be remarkably enhanced.

The hot-dip galvanized steel sheet of the present invention contains a retained austenite phase as a secondary phase with a volume ratio of not less than 1% of the entire structure. With a content of the retained austenite phase of less than 1%, high elongation (El) cannot be obtained. In order to obtain higher elongation (El), the retained austenite phase is preferably contained not less than 2% and more preferably not less than 3%. The secondary phase may be a single retained austenite phase having a volume ratio of not less than 1%, or may be a mixture of a retained austenite phase of a volume ratio of not less than 1% and an auxiliary (other) phase, for example, a pearlite phase, a bainite phase, and/or a martensite phase.

The reasons for limiting the composition of the hot-dip galvanized steel sheet of the present invention will now be described.

C: not more than 0.20%

C is an element, which improves the strength of a steel sheet and promotes the formation of a composite structure of a primary phase comprising ferrite and tempered martensite and a secondary phase containing retained austenite. In the present invention, from the viewpoint of formation of the composite structure, C is preferably contained in an amount of not less than 0.01%. A C content exceeding 0.20% causes an increase in carbide content in the steel, resulting in a decrease in ductility, and hence a decrease in press formability. A more serious problem is that a C content exceeding 0.20% leads to remarkable deterioration of spot weldability and arc weldability. For these reasons, in the present invention, the C content is limited to not more than 0.20%. From the viewpoint of formability, the C content is preferably not more than 0.18%.

Si: not more than 2.0%

Si is a useful strengthening element, which improves strength of a steel sheet without a marked decrease in ductility of the steel sheet, and is necessary for obtaining retained austenite. These effects are particularly remarkable at an Si content of not less than 0.1% and therefore, the Si content is preferably not less than 0.1%. An Si content exceeding 2.0%, however, leads to deterioration of press formability and degrades the platability. Therefore, the Si content is limited to not more than 2.0%.

Mn: not more than 3.0%

Mn is a useful element, which strengthens the steel and prevents hot cracking caused by S, and is therefore contained in an amount according to S content. These effects are particularly remarkable at an Mn content of not less than 0.5%. However, an Mn content exceeding 3.0% results in deterioration of press formability and weldability. The Mn content is, therefore, limited to not more than 3.0%. More preferably, the Mn content is not less than 1.0%.

P: not more than 0.10%

P strengthens the steel. In the present invention, P is preferably contained in an amount of not less than 0.005% for securing the strength. However, an excess content of P exceeding 0.10% causes deterioration of press formability. For this reason, in the present invention, a P content is limited to not more than 0.10%. When more enhanced press formability is required, the P content is preferably not more than 0.08%.

S: not more than 0.02%

S is an element, which is present as inclusions in a steel sheet and causes deterioration of ductility, formability, and particularly stretch flanging formability of the steel sheet, and it should be the lowest possible. An S content reduced to not more than 0.02% does not exert much adverse effect and therefore, the S content is limited to not more than 0.02% in the present invention. When excellent stretch flanging formability is required, the S content is preferably not more than 0.010%.

Al: not more than 0.10%

Al is a deoxidizing element of steel, and is useful for improving cleanliness of steel. In addition, Al is effective for the formation of the retained austenite. In the present invention, the Al content is preferably not less than 0.01%. An excess Al content exceeding 0.30%, however, cannot give a further enhanced effect because of saturation of the effect, and causes deterioration of press formability. The Al content is, therefore, limited to not more than 0.30%. The present invention also include a steel making process using other deoxidizers, for example, Ti or Si, and steel sheets produced by such deoxidation methods are also included in the scope of the present invention. In this case, addition of Ca or REM to molten steel does not impair the features of the steel sheet of the present invention at all. Of course, steel sheets containing Ca or REM are included within the scope of the present invention.

N: not more than 0.02%

N is an element, which increases strength of a steel sheet through solid solution strengthening or strain age hardening, and is preferably contained in an amount of not less than 0.001%. An N content exceeding 0.02% causes an increase in the nitride content in the steel sheet, which causes serious deterioration of ductility and of press formability. The N content is, therefore, limited to not more than 0.02%. When further improvement of press formability is required, the N content is preferably not more than 0.01%.

Cu: 0.5 to 3.0%

Cu is an element, which remarkably increases strain age hardening of a steel sheet (increase in strength after pre-deformation/heat treatment), and is the most important element in the present invention. With a Cu content of less than 0.5%, an increase in tensile strength ΔTS of not less than 80 MPa cannot be obtained by changing the pre-deformation/heat treatment conditions. In the present invention, therefore, Cu should be contained in an amount of not less than 0.5%. With a Cu content exceeding 3.0%, however, the effect is saturated, leading to unfavorable economic effects. Furthermore, deterioration of press formability occurs, and the surface quality of the steel sheet is degraded. The Cu content is, therefore, limited within the range of 0.5 to 3.0%. In order to simultaneously achieve a higher ΔTS and excellent press formability, the Cu content is preferably within the range of 1.0 to 2.5%.

In the present invention, it is preferable that the composition containing Cu further contain, in weight percent, at least one of the following Groups A to C:

Group A: Ni: not more than 2.0%;

Group B: at least one of Cr and Mo: not more than 2.0% in total; and

Group C: at least one of Nb, Ti, and V: not more than 0.2% in total.

Group A: Ni: not more than 2.0%

Group A: Ni is an element effective for preventing surface defects produced by Cu contained in the steel sheet, and can be contained as required. The Ni content depends on the Cu content, and is preferably about a half the Cu content, more specifically, within the range of about 30 to about 80% of the Cu content. An Ni content exceeding 2.0% cannot give further enhancement in the effect because of saturation of the effect, leading to economic disadvantages, and causes deterioration of press formability. For these reasons, the Ni content is preferably limited to not more than 2.0%.

Group B: at least one of Cr and Mo: not more than 2.0% in total

Group B: Both Cr and Mo strengthen the steel sheet, like Mn, and can be contained as required. However, if at least one of Cr and Mo are contained in an amount exceeding 2.0% in total, press formability is impaired. The total content of Cr and Mo is preferably limited to not more than 2.0%. From the viewpoint of press formability, a Cr content is preferably not less than 0.1%, and an Mo content is preferably not less than 0.1%.

Group C: at least one of Nb, Ti, and V: not more than 0.2% in total

Group C: Nb, Ti, and V are carbide-forming elements and increase strength by fine dispersion of carbides, and can be selected and contained as required. However, if the total content of at least one of Nb, Ti, and V exceeds 0.2%, press formability is impaired. Thus, the total content of Nb, Ti and V is preferably limited to not more than 0.2%. The above-mentioned effect can be achieved at an Nb content of not less than 0.01%, at a Ti content of not less than 0.01%, and at a V content of not less than 0.01%.

In the present invention, in place of Cu, at least one selected from the group consisting of Mo: 0.05 to 2.0%, Cr: 0.05 to 2.0%, Cr, and W: 0.05 to 2.0% may be contained in an amount of not more than 2.0% in total.

At least one selected from the group consisting of Mo: 0.05 to 2.0%, Cr: 0.05 to 2.0% and W: 0.05 to 2.0%, in an amount of not more than 2.0% in total In the present invention, all of Mo, Cr, and W, as well as Cu, are the most important elements, which remarkably increase strain age hardening (increase in strength after pre-deformation/heat treatment) of the steel sheet. When a steel sheet containing at least one of Mo, Cr, and W, and having a composite structure comprising a primary phase of a ferrite phase and a tempered martensite phase and a secondary phase containing retained austenite in a volume ratio of not less than 1% is subjected to prestrain (pre-deformation) of not less than 5% and a low-temperature heat treatment (heat treatment), the retained austenite is transformed into martensite by strain-induced transformation. Then, the formation of fine carbide precipitation is induced by the strain at a low temperature occurs in the martensite, resulting in an increase in tensile strength ΔTS of not less than 80 MPa. With a content of each of these elements of less than 0.05%, changing the steel sheet structure and pre-deformation/heat treatment conditions does not give an increase in tensile strength ΔTS of not less than 80 MPa. Therefore, in the present invention, each of Mo, Cr, and W is preferably contained in an amount of not less than 0.05%. If the content of each of Mo, Cr, and W each exceeds 2.0%, a further enhanced effect corresponding to the content cannot be expected as a result of saturation of the effect, leading to economic disadvantages, and this results in deterioration of press formability. For these reasons, the content of each of Mo, Cr, and W is preferably limited within the range of 0.05 to 2.0%, and the total content thereof is preferably limited to not more than 2.0%.

The above-mentioned composition containing at least one of Mo, Cr, and W preferably further contains at least one of Nb, Ti, and V in an amount of not more than 2.0% in total.

At least one of Nb, Ti, and V, in a total amount of not more than 2.0%

Nb, Ti, and V are carbide-forming elements and can be selected and contained as required, when at least one of Mo, Cr, and W is added. However, a total content of Nb, Ti, and V exceeding 2.0% causes deterioration of press formability. Thus, the total content of Nb, Ti, and V is preferably limited to not more than 2.0%. At least one of Mo, Cr, and W are added, at least one of Nb, Ti, and V are added, and the structure is transformed into a composite structure of a primary phase comprising a ferrite phase and a tempered martensite phase and a secondary phase containing retained austenite. This forms fine composite carbides in martensite which was formed by strain-induced transformation during the pre-deformation/heat treatment, and strain-induced fine precipitation at a low temperature occurs, resulting in an increase in tensile strength ΔTS of not less than 80 MPa. In order to obtain this effect, Nb, Ti, and V is preferably contained in an amount of not less than 0.01% for Nb, in an amount of not less than 0.01% for Ti and in an amount of not less than 0.01% for V, and at least one of Nb, Ti, and V can be selected and contained as required.

Although no particular restriction is imposed, apart from the above-mentioned constituents, the composition may contain B: not more than 0.1%, Ca: not more than 0.1%, Zn: not more than 0.1%, and REM: not more than 0.1% without any problem.

The balance of the composition of the steel is Fe and incidental impurities. Allowable incidental impurities include Sb: not more than 0.01%, Sn: not more than 0.1%, Zn: not more than 0.01%, and Co: not more than 0.1%.

The method for manufacturing the hot-dip galvanized steel sheet of the present invention will now be described.

The hot-dip galvanized steel sheet is preferably manufactured through a primary heat treatment step of heating a steel sheet having the above-mentioned composition to a temperature of not less than the $A_{C1}$ transformation point and rapidly cooling the steel sheet, a secondary heat treatment step of heating the steel sheet to a temperature of ferrite/austenite dual phase within the range of $A_{C1}$ transformation point to $A_{C3}$ transformation point on a continuous hot-dip galvanizing line, and a hot-dip galvanizing step of forming a hot-dip galvanizing layer on each surface of the steel sheet.

A hot-rolled steel sheet or a cold-rolled steel sheet may preferably be used in this process. A preferable manufacturing method of the steel sheet used will now be described, although the method is not limited thereto in the present invention.

A suitable method for manufacturing the hot-rolled steel sheet used as a galvanizing substrate will be described.

A material (steel slab) used is preferably manufactured by a continuous casting process to prevent macro-segregation of the constituents, but it may be manufactured by an ingot casting process or a thin-slab casting process. A conventional process employed in this embodiment includes the steps of manufacturing a steel slab, cooling the steel slab to room temperature, and reheating the slab. Alternatively, an energy-saving process is applicable with no problem. As the energy-saving process, for example, a direct-hot charge rolling process of charging the hot steel slab into a reheating furnace without cooling the same, and a direct rolling process of immediately rolling after a short temperature holding are applicable.

The material (steel slab) is first heated, and subjected to a hot rolling step to form a hot-rolled steel sheet. Known hot rolling conditions may be employed without problem as long as a hot-rolled steel sheet having a desired thickness is formed. Preferable conditions for hot rolling are as follows:

Slab reheating temperature: not less than 900° C.

In the case of a steel slab containing Cu, the slab heating temperature is preferably the lowest possible to prevent surface defects caused by Cu. However, a heating temperature of less than 900° C. causes an increase in the rolling load, thus increasing the risk of occurrence of a trouble during the hot rolling. Considering the increase in scale loss caused by accelerated oxidation, the slab heating temperature is preferably not more than 1,300° C. From the viewpoint of decreasing the slab heating temperature and preventing occurrence of troubles during hot rolling, use of a so-called sheet bar heater, which heats a sheet bar, is effective.

Finish rolling end temperature: not less than 700° C.

At a finish rolling end temperature FDT of not less than 700° C., it is possible to obtain a uniform hot-rolled mother sheet structure which can give an excellent formability after cold rolling and recrystallization annealing. A finish rolling end temperature FDT of less than 700° C. leads to a non-uniform structure of the hot-rolled mother sheet and a higher rolling load during hot rolling, thus increasing the risk of occurrence of troubles during hot rolling. Thus, the FDT for the hot rolling step is preferably not less than 700° C.

Coiling temperature: not more than 800° C.

The coiling temperature CT is preferably not more than 800° C., and more preferably not less than 200° C. The CT exceeding 800° C. tends to cause a decrease in yield as a result of an increased scale loss. With a CT of less than 200° C., the steel sheet shape is seriously impaired, and there is an increasing risk of occurrence of inconveniences in practical use.

The hot-rolled steel sheet suitably applicable in the present invention is preferably prepared by heating the slab to not less than 900° C., hot-rolling the heated slab at a finish rolling end temperature of not less than 700° C., and coiling the hot-rolled sheet at a coiling temperature of not less than 800° C., and preferably not less than 200° C.

In the above-mentioned hot rolling step, all or part of finish rolling may be lubrication rolling, which reduces the rolling load during the hot rolling. The lubrication rolling is effective also from the viewpoint of achieving a uniform steel sheet shape and a uniform material quality. The frictional coefficient on the lubrication rolling is preferably within the range of 0.25 to 0.10. It is desirable to connect neighboring sheet bars to each other to perform a continuous finish rolling process. Application of the continuous rolling process is desirable also from the viewpoint of operational stability of hot rolling.

The hot-rolled sheet with scales may be annealed to form an internal oxide layer at the surface of the steel sheet. The internal oxide layer, which prevents concentration of Si, Mn, and P at the surface, improves hot-dip galvanizing ability.

The hot-rolled sheet manufactured by the above-mentioned method may be used as an original sheet for plating. Alternatively, the hot-rolled sheet may be cold-rolled to form a cold-rolled sheet used as an original sheet for plating.

In the cold rolling step, any cold rolling condition may be used without particular restriction so far as such a condition permits production of cold-rolled steel sheets with desired dimensions and shapes. The reduction in cold rolling is preferably not less than 40%. A reduction of less than 40% inhibits uniform recrystallization during the subsequent primary heat treatment.

In the present invention, the above-mentioned steel sheet (hot-rolled sheet or cold-rolled sheet) is subjected to a primary heat treatment step including heating to a temperature of not less than the $A_{C1}$ transformation point and rapid cooling.

Heating in the primary heat treatment, the steel sheet is preferably held at a temperature of not less than $A_{C1}$ transformation point, more preferably not less than ($A_{C3}$ transformation point −50° C.), and most preferably not less than $A_{C3}$ transformation point. After heating, the steel sheet is preferably rapidly cooled to a temperature of not more than the Ms point at a cooling rate of not less than 10° C./second. During the primary heat treatment step, lath martensite is produced in the steel sheet. In the present invention, the most important point is to form lath martensite during the primary heat treatment step. Unless the lath martensite is formed in the steel sheet, it is difficult to form a secondary phase containing retained austenite in the subsequent steps.

When a hot-rolled steel sheet, subjected to final hot rolling at a temperature of not less than ($A_{r3}$ transformation point −50° C.), is used as an original sheet for plating, the primary heat treatment step can be substituted the steel sheet for rapidly cooling to a temperature of not less than Ms point at a cooling rate of not less than 10° C./second during cooling after the final hot rolling.

Then, the steel sheet containing lath martensite formed during the above-described primary heat treatment is subjected to a secondary heat treatment step for heating to and holding at a temperature in the range of $A_{C1}$ transformation point to $A_{C3}$ transformation point on a continuous hot-dip galvanizing line. During the secondary heat treatment step, the lath martensite formed during the primary heat treatment step is changed into tempered martensite, and a part of the structure is transformed into austenite for formation of retained austenite.

A heating and holding temperature of less than the $A_{C1}$ transformation point in the secondary heat treatment step cannot form retained austenite. A heating and holding temperature exceeding the $A_{C3}$ transformation point causes retransformation of the entire structure of the steel sheet to austenite, whereby the tempered martensite disappears. For these reasons, the heating and holding temperature in the secondary heat treatment is within the range of the $A_{C1}$ transformation point to the $A_{C3}$ transformation point.

Then, the steel sheet heated to and held at a temperature in the range of the $A_{C1}$ transformation point to the $A_{C3}$ transformation point in the second heat treatment step is preferably cooled to a temperature of not more than 500° C. at a cooling rate of 5° C./second or more, from the viewpoint of forming retained austenite. This can achieve a composite structure of a primary phase containing a ferrite phase and a tempered martensite phase and a secondary phase containing retained austenite in the steel sheet.

The steel sheet after the secondary heat treatment is subsequently subjected to a hot-dip galvanizing treatment step on a continuous hot-dip galvanizing line.

The hot-dip galvanizing treatment may be carried out under treatment conditions (galvanizing bath temperature: 450 to 500° C.) used in a usual continuous hot-dip galvanizing line without a particular restriction. Because galvanizing at an excessively high temperature leads to a poor platability, galvanizing is preferably conducted at a temperature of not more than 500° C. Galvanizing at a temperature of less than 450° C. causes deterioration of platability. From the viewpoint of forming martensite, the cooling rate from the hot-dip galvanizing temperature to 300° C. is preferably not less than 5° C./second.

For the purpose of adjusting the galvanizing weight as required after galvanizing, wiping may be performed.

After the hot-dip galvanizing treatment, an alloying treatment of a galvanizing layer may be applied. The alloying treatment is preferably carried out by reheating the plated sheet to a temperature in the range of 450 to 500° C. after the hot-dip galvanizing treatment. At an alloying treatment temperature of less than 450° C., alloying is decelerated, resulting in low productivity. On the other hand, an alloying treatment temperature exceeding 550° C. causes deterioration of platability, makes it difficult to secure a required amount of retained austenite, and decrease ductility of the steel sheet.

After the alloying treatment, the sheet is preferably cooled to 300° C. at a cooling rate of not less than 5° C./second. An extremely low cooling rate after the alloying treatment makes it difficult to form a required amount of retained austenite.

In the present invention, pickling treatment for removing a concentrated surface layer of the constituents formed on the surface of the steel sheet during the primary heat treatment step is preferably performed between the primary heat treatment step and the hot-dip galvanizing step, for the improvement in platability. By the primary heat treatment, P and oxides of Si, Mn, Cr, etc. are concentrated on the steel surface to form a concentrated surface layer. It is favorable for improving platability to remove this concentrated surface layer through pickling and to conduct annealing in a reducing atmosphere subsequently on the continuous hot-dip galvanizing line.

After the hot-dip galvanizing or the alloying treatment step, a temper rolling step with a reduction of not more than 10% may be applied for adjustments such as shape correction and surface roughness adjustment.

To the steel sheet of the present invention, any special treatment may be applied after the hot-dip galvanizing, to improve chemical treatment ability, weldability, press formability, and corrosion resistance.

EXAMPLES

Example 1

Molten steels having the compositions shown in Table 1 were made in a converter and cast into steel slabs by a continuous casting process. Each of these steel slabs was reheated, and hot-rolled under conditions shown in Table 2 into a hot-rolled steel strip (hot-rolled sheet) having a thickness of 2.0 mm. The hot-rolled sheet was temper-rolled at a reduction of 1.0%.

TABLE 1

| STEEL | COMPOSITION (wt. %) | | | | | | | | | | |
|---|---|---|---|---|---|---|---|---|---|---|---|
| NO. | C | Si | Mn | P | S | Al | N | Cu | Ni | Cr, Mo, | Nb, Ti, V |
| A | 0.09 | 1.45 | 1.05 | 0.01 | 0.003 | 0.034 | 0.002 | 1.52 | — | — | — |
| B | 0.12 | 1.50 | 1.20 | 0.01 | 0.002 | 0.030 | 0.002 | 1.43 | 0.65 | Mo: 0.32 | — |
| C | 0.10 | 1.48 | 1.35 | 0.01 | 0.002 | 0.028 | 0.002 | 1.25 | 0.52 | Cr: 0.53 | — |
| D | 0.15 | 1.53 | 1.45 | 0.01 | 0.003 | 0.033 | 0.002 | 1.33 | 0.44 | — | Nb: 0.01, Ti: 0.01, V: 0.01 |
| E | 0.12 | 1.48 | 1.55 | 0.01 | 0.005 | 0.032 | 0.002 | 0.15 | — | — | — |
| F | 0.11 | 1.50 | 1.08 | 0.01 | 0.004 | 0.032 | 0.002 | 0.68 | — | — | — |
| G | 0.13 | 1.52 | 1.22 | 0.01 | 0.004 | 0.030 | 0.002 | 0.98 | — | — | — |
| H | 0.12 | 1.42 | 1.22 | 0.01 | 0.003 | 0.033 | 0.002 | 1.55 | 0.62 | — | — |
| I | 0.11 | 1.52 | 1.52 | 0.01 | 0.003 | 0.031 | 0.002 | 1.49 | — | Cr: 0.15, Mo: 0.12 | — |
| J | 0.13 | 1.43 | 1.48 | 0.01 | 0.003 | 0.028 | 0.002 | 1.43 | — | Mo: 0.21 | — |
| K | 0.15 | 1.58 | 1.05 | 0.01 | 0.003 | 0.030 | 0.002 | 1.52 | — | — | Nb: 0.01 |
| L | 0.14 | 1.60 | 1.21 | 0.01 | 0.003 | 0.028 | 0.002 | 1.48 | — | Cr: 0.11 | Ti: 0.01 |

TABLE 2

| | | | HOT ROLLING - COOLING AFTER ROLLING | | | | | | | | | | |
|---|---|---|---|---|---|---|---|---|---|---|---|---|---|
| | | SLAB | FINISH ROLLING | TIME BE-FORE | FORCED COOLING | | ISOTHERMAL | | SLOW COOLING TREATMENT | | | COOLING | COIL-ING |
| | | REHEATING | END | START | COOL- | | HOLDING | | COOL- | | | RATE | |
| STEEL SHEET NO. | STEEL NO. | TEMP. SRT ° C. | TEMP. FDT ° C. | COOL-ING S | ING RATE ° C./s | STOP TEMP. ° C. | TEMP. ° C. | HOLD-ING TIME S | INITIAL TEMP. ° C. | ING RATE ° C./s | STOP TEMP. ° C. | BEFORE COILING ° C./s | TEMP. CT ° C. |
| 1 | A | 1250 | 850 | 0.5 | 100 | 710 | 710 | 5 | — | — | — | 80 | 450 |
| 2 | B | 1250 | 850 | 0.5 | 80 | 690 | 690 | 5 | — | — | — | 60 | 450 |
| 3 | | 1250 | 850 | 0.3 | 30 | 700 | — | — | 700 | 10 | 650 | 30 | 600 |
| 4 | | 1250 | 850 | 0.5 | 30 | 680 | — | — | 680 | 10 | 650 | 20 | 450 |
| 5 | C | 1250 | 850 | 0.1 | 60 | 700 | 700 | 5 | — | — | — | 60 | 450 |
| 6 | D | 1250 | 850 | 0.5 | 80 | 680 | 680 | 5 | — | — | — | 80 | 450 |
| 7 | E | 1250 | 850 | 0.5 | 70 | 710 | 710 | 5 | — | — | — | 80 | 450 |
| 8 | F | 1250 | 850 | 0.5 | 60 | 700 | 700 | 5 | — | — | — | 70 | 450 |
| 9 | G | 1250 | 850 | 0.5 | 80 | 690 | 690 | 5 | — | — | — | 80 | 450 |
| 10 | H | 1250 | 850 | 0.5 | 60 | 680 | 680 | 5 | — | — | — | 60 | 450 |
| 11 | I | 1250 | 850 | 0.1 | 60 | 690 | — | — | 690 | 10 | 650 | 60 | 450 |
| 12 | J | 1250 | 850 | 0.1 | 80 | 700 | — | — | 700 | 10 | 650 | 60 | 450 |
| 13 | K | 1250 | 850 | 0.1 | 80 | 680 | 680 | 5 | 680 | 10 | 640 | 80 | 450 |
| 14 | L | 1250 | 850 | 0.3 | 60 | 690 | 690 | 5 | 690 | 10 | 650 | 60 | 450 |
| 15 | H | 1250 | 750 | 0.5 | 50 | 620 | 620 | 5 | 620 | 10 | 580 | 60 | 450 |

TABLE 2-continued

| | | HOT ROLLING - COOLING AFTER ROLLING | | | | | | | | | | | |
|---|---|---|---|---|---|---|---|---|---|---|---|---|---|
| | | SLAB REHEATING | FINISH ROLLING END | TIME BE-FORE START | FORCED COOLING | | ISOTHERMAL HOLDING | | SLOW COOLING TREATMENT | | | COOLING RATE | COIL-ING |
| STEEL SHEET NO. | STEEL NO. | TEMP. SRT ° C. | TEMP. FDT ° C. | COOL-ING S | COOL-ING RATE ° C./s | STOP TEMP. ° C. | TEMP. ° C. | HOLD-ING TIME S | INITIAL TEMP. ° C. | COOL-ING RATE ° C./s | STOP TEMP. ° C. | BEFORE COILING ° C./s | TEMP. CT ° C. |
| 16 | | 1250 | 850 | 3.0 | 50 | 680 | 680 | 12 | — | — | — | 70 | 450 |
| 17 | | 1250 | 850 | 0.5 | 30 | 680 | 680 | 5 | 680 | 10 | 650 | 60 | 450 |
| 18 | | 1250 | 850 | 0.5 | 60 | 600 | 600 | 5 | — | — | — | 70 | 450 |
| 19 | | 1250 | 850 | 0.5 | 60 | 700 | — | — | — | — | — | 70 | 450 |

For the resulting hot-rolled steel strip (hot-rolled steel sheet), the microstructure, tensile properties, strain age hardenability, and hole expanding property were determined. Press formability was evaluated in terms of elongation El (ductility), TS×El balance and hole expanding ratio λ. Test methods were as follows.

(1) Microstructure

A test piece was sampled from each of the resultant hot-rolled sheets, and the microstructure of the cross-section (section C) perpendicular to the rolling direction of the steel sheet was observed with an optical microscope and a scanning electron microscope. The volume ratios of the ferrite phase, the bainite phase, and the martensite phase in the steel sheet were determined with an image analyzer using a photograph of the cross-sectional structure at a magnification of 1,000. The volume ratios of the retained austenite phase were determined by polishing the steel sheet to the central plane in the thickness direction, and by measuring diffraction X-ray intensities at the central plane. Mo Kα-rays were used as incident X-rays, the ratios of the diffraction X-ray strengths of the planes {200}, {220} and {311} of the retained austenite phase to the diffraction X-ray strengths of the planes {110}, {200} and {211} of the ferrite phase, respectively, were determined, and the volume ratio of the retained austenite was determined from the average of these ratios.

(2) Tensile Properties

JIS No. 5 tensile test pieces were sampled from the resultant hot-rolled sheets, and a tensile test was carried out in accordance with JIS Z 2241 to determine the yield strength YS, the tensile strength TS, and the elongation El.

(3) Strain Age Hardenability

JIS No. 5 test pieces were sampled in the rolling direction from the resultant hot-rolled steel sheets. A plastic deformation of 5% was applied as a pre-deformation (tensile prestrain). After a heat treatment at 250° C. for 20 minutes, a tensile test was carried out to determine tensile properties (yield stress $YS_{TH}$ and tensile strength $TS_{HT}$) and to calculate $\Delta YS=YS_{TH}-YS$, and $\Delta TS=TS_{HT}-TS$, wherein $YS_{TH}$ and $TS_{HT}$ were yield stress and tensile strength after the pre-deformation/heat treatment, and YS and TS were yield stress and tensile strength of the hot-rolled steel sheets.

(4) Hole Expanding Property

A hole was formed by punching a test piece sampled from the resultant hot-rolled sheet in accordance with Japan Iron and Steel Federation Standard (JFS T 1001-1996) with a punch having a diameter of 10 mm. Then, the hole was expanded with a conical punch having a vertical angle of 60° so that burrs were produced on the outside until cracks passing through the thickness form, thereby determining the hole expanding ratio λ. The hole expanding ratio λ was calculated by the formula: $\lambda(\%)=\{(d-d_0)/d_0\}\times 100$, where $d_0$ is initial hole diameter (punch diameter), and d is inner hole diameter upon occurrence of cracks.

The results are shown in Table 3.

TABLE 3

| | | MICROSTRUCTURE | | | | HOT-ROLLED SHEET PROPERTIES TENSILE PROPERTIES | | | | PROPERTIES AFTER PRE-DEFORMATION - HEAT TREATMENT | | STRAIN AGE HARDENING PROPERTIES | | HOLE EX-PAN-SION HOLE EX-PAND-ING RA-TIO | |
|---|---|---|---|---|---|---|---|---|---|---|---|---|---|---|---|
| | | PRI-MARY PHASE | SECONDARY PHASE | | | | | | | | | | | | |
| STEEL SHEET NO. | STEEL NO. | F VOL-UME RA-TIO % | A VOL-UME RA-TIO % | OTHER PHASES KIND* | VOL-UME RA-TIO % | YS (MPa) | TS (MPa) | El % | TS × El MPa % | $YS_{HT}$ MPa | $TS_{HT}$ MPa | ΔYS MPa | ΔTS MPa | λ % | RE-MARKS |
| 1 | A | 75 | 8 | B, M | 25 | 470 | 620 | 34 | 21080 | 715 | 790 | 245 | 170 | 140 | EXAM-PLE |
| 2 | B | 80 | 11 | B, M | 20 | 490 | 650 | 33 | 21450 | 750 | 830 | 260 | 180 | 135 | EXAM-PLE |

TABLE 3-continued

| STEEL SHEET NO. | STEEL NO. | MICROSTRUCTURE: PRIMARY PHASE F VOLUME RATIO % | SECONDARY PHASE A VOLUME RATIO % | SECONDARY PHASE OTHER PHASES KIND* | SECONDARY PHASE VOLUME RATIO % | HOT-ROLLED SHEET PROPERTIES TENSILE PROPERTIES YS (MPa) | TS (MPa) | El % | TS × El MPa % | PROPERTIES AFTER PRE-DEFORMATION - HEAT TREATMENT $YS_{HT}$ MPa | $TS_{HT}$ MPa | STRAIN AGE HARDENING PROPERTIES ΔYS MPa | ΔTS MPa | HOLE EXPANSION HOLE EXPANDING RATIO λ % | REMARKS |
|---|---|---|---|---|---|---|---|---|---|---|---|---|---|---|---|
| 3 | | 75 | — | P | 25 | 660 | 720 | 15 | 10800 | 730 | 760 | 70 | 40 | 70 | COMP. EX. |
| 4 | | 76 | — | P, B | 24 | 600 | 660 | 16 | 10560 | 660 | 695 | 60 | 35 | 60 | COMP. EX. |
| 5 | C | 78 | 9 | B, M | 22 | 490 | 650 | 33 | 21450 | 730 | 810 | 240 | 160 | 145 | EXAMPLE |
| 6 | D | 75 | 9 | B, M | 25 | 500 | 660 | 32 | 21120 | 745 | 825 | 245 | 165 | 140 | EXAMPLE |
| 7 | E | 80 | 8 | B, M | 20 | 410 | 540 | 39 | 21060 | 715 | 550 | 305 | 10 | 60 | COMP. EX. |
| 8 | F | 81 | 10 | B, M | 19 | 470 | 620 | 34 | 21080 | 675 | 750 | 205 | 130 | 140 | EXAMPLE |
| 9 | G | 80 | 9 | B, M | 20 | 460 | 610 | 35 | 21350 | 690 | 765 | 230 | 155 | 135 | EXAMPLE |
| 10 | H | 80 | 9 | B, M | 20 | 490 | 650 | 33 | 21450 | 750 | 830 | 260 | 180 | 135 | EXAMPLE |
| 11 | I | 81 | 8 | B, M | 19 | 470 | 620 | 34 | 21080 | 675 | 750 | 205 | 130 | 140 | EXAMPLE |
| 12 | J | 78 | 10 | B, M | 22 | 500 | 660 | 32 | 21120 | 745 | 825 | 245 | 165 | 140 | EXAMPLE |
| 13 | K | 80 | 8 | B, M | 20 | 470 | 620 | 34 | 21080 | 715 | 790 | 245 | 170 | 140 | EXAMPLE |
| 14 | L | 75 | 10 | B, M | 25 | 500 | 660 | 32 | 21120 | 745 | 825 | 245 | 165 | 140 | EXAMPLE |
| 15 | H | 80 | — | P, B | 20 | 600 | 660 | 16 | 10560 | 660 | 695 | 60 | 35 | 60 | COMP. EX. |
| 16 | | 80 | — | P | 20 | 590 | 650 | 15 | 9750 | 660 | 690 | 70 | 40 | 70 | COMP. EX. |
| 17 | | 80 | — | P, B | 20 | 610 | 670 | 14 | 9380 | 670 | 705 | 60 | 35 | 70 | COMP. EX. |
| 18 | | 80 | — | P, | 20 | 580 | 640 | 17 | 10880 | 650 | 675 | 70 | 35 | 60 | COMP. EX. |
| 19 | | 78 | — | P, B | 22 | 590 | 650 | 15 | 9750 | 650 | 690 | 60 | 40 | 70 | COMP. EX. |

*F: FERRITE,
A: AUSTENITE,
M: MARTENSITE,
P: PEARLITE,
B: BAINITE

All Examples according to the present invention show a high elongation El, a high strength/ductility balance (TS× El), and a high hole expanding ratio λ, suggesting excellent stretch flanging formability. In addition, all Examples according to the present invention show a very large ΔTS, suggesting that these samples had excellent strain age hardenability. Comparative Examples outside the scope of the present invention, in contrast, suggest that the samples have a low elongation El, a small hole expanding ratio λ, a low ΔTS, and decreased press formability and strain age hardenability.

Example 2

Molten steels having the compositions shown in Table 4 were made in a converter and cast into steel slabs by a continuous casting process. Each of these steel slabs were reheated, and hot-rolled under conditions shown in Table 5 into a hot-rolled steel strip (hot-rolled sheet) having a thickness of 2.0 mm. The hot-rolled steel strip was temper-rolled at a reduction of 1.0%.

TABLE 1

| STEEL | COMPOSITION (wt. %) | | | | | | | | | | |
|---|---|---|---|---|---|---|---|---|---|---|---|
| NO. | C | Si | Mn | P | S | Al | N | Cu | Ni | Cr, Mo, | Nb, Ti, V |
| A | 0.09 | 1.45 | 1.05 | 0.01 | 0.003 | 0.034 | 0.002 | 1.52 | — | — | — |
| B | 0.12 | 1.50 | 1.20 | 0.01 | 0.002 | 0.030 | 0.002 | 1.43 | 0.65 | Mo: 0.32 | — |
| C | 0.10 | 1.48 | 1.35 | 0.01 | 0.002 | 0.028 | 0.002 | 1.25 | 0.52 | Cr: 0.53 | — |
| D | 0.15 | 1.53 | 1.45 | 0.01 | 0.003 | 0.033 | 0.002 | 1.33 | 0.44 | — | Nb: 0.01, Ti: 0.01, V: 0.01 |
| E | 0.12 | 1.48 | 1.55 | 0.01 | 0.005 | 0.032 | 0.002 | 0.15 | — | — | — |
| F | 0.11 | 1.50 | 1.08 | 0.01 | 0.004 | 0.032 | 0.002 | 0.68 | — | — | — |
| G | 0.13 | 1.52 | 1.22 | 0.01 | 0.004 | 0.030 | 0.002 | 0.98 | — | — | — |
| H | 0.12 | 1.42 | 1.22 | 0.01 | 0.003 | 0.033 | 0.002 | 1.55 | 0.62 | — | — |
| I | 0.11 | 1.52 | 1.52 | 0.01 | 0.003 | 0.031 | 0.002 | 1.49 | — | Cr: 0.15, Mo: 0.12 | — |
| J | 0.13 | 1.43 | 1.48 | 0.01 | 0.003 | 0.028 | 0.002 | 1.43 | — | Mo: 0.21 | — |
| K | 0.15 | 1.58 | 1.05 | 0.01 | 0.003 | 0.030 | 0.002 | 1.52 | — | — | Nb: 0.01 |
| L | 0.14 | 1.60 | 1.21 | 0.01 | 0.003 | 0.028 | 0.002 | 1.48 | — | Cr: 0.11 | Ti: 0.01 |

For the resultant hot-rolled steel strip (hot-rolled steel sheet), the microstructure, the tensile properties, the strain age hardenability, and the hole expanding ratio were determined as in Example 1. Press formability was evaluated in terms of elongation El (ductility), TS×El balance and the hole expanding ratio λ.

The results obtained are shown in Table 6.

TABLE 6

| STEEL | | MICROSTRUCTURE | | | | HOT-ROLLED SHEET PROPERTIES TENSILE PROPERTIES | | | | PROPERTIES AFTER PRE-DEFORMATION - HEAT TREATMENT | | STRAIN AGE HARDENING PROPERTIES | | HOLE EXPANSION HOLE EXPANDING RATIO | |
|---|---|---|---|---|---|---|---|---|---|---|---|---|---|---|---|
| | | PRIMARY PHASE | SECONDARY PHASE | | | | | | | | | | | | |
| SHEET NO. | STEEL NO. | F VOLUME RATIO % | A VOLUME RATIO % | OTHER PHASES KIND* | VOLUME RATIO % | YS (MPa) | TS (MPa) | El % | TS × El MPa % | $YS_{HT}$ MPa | $TS_{HT}$ MPa | ΔYS MPa | ΔTS MPa | λ % | REMARKS |
| 2-1 | 2A | 76 | 8 | B, M | 24 | 460 | 610 | 35 | 21350 | 695 | 760 | 235 | 150 | 135 | EXAMPLE |
| 2-2 | 2B | 79 | 9 | B, M | 21 | 480 | 640 | 33 | 21120 | 730 | 800 | 250 | 160 | 140 | EXAMPLE |
| 2-3 | | 76 | — | P | 24 | 650 | 710 | 15 | 10650 | 700 | 730 | 50 | 20 | 70 | COMP. EX. |
| 2-4 | | 75 | — | P, B | 25 | 590 | 650 | 14 | 9100 | 635 | 665 | 45 | 15 | 65 | COMP. EX. |
| 2-5 | 2C | 76 | 9 | B, M | 24 | 480 | 630 | 34 | 21420 | 715 | 785 | 235 | 155 | 140 | EXAMPLE |
| 2-6 | 2D | 78 | 8 | B, M | 22 | 490 | 650 | 33 | 21450 | 725 | 810 | 235 | 160 | 135 | EXAMPLE |
| 2-7 | 2E | 80 | 7 | B, M | 20 | 390 | 510 | 42 | 21420 | 620 | 670 | 230 | 160 | 130 | EXAMPLE |
| 2-8 | 2F | 81 | 9 | B, M | 19 | 450 | 590 | 36 | 21240 | 660 | 730 | 210 | 140 | 135 | EXAMPLE |
| 2-9 | 2G | 79 | 10 | B, M | 21 | 450 | 600 | 36 | 21600 | 570 | 630 | 120 | 30 | 65 | COMP. EX. |
| 2-10 | 2H | 78 | 10 | B, M | 22 | 480 | 630 | 34 | 21420 | 715 | 785 | 235 | 155 | 130 | EXAMPLE |
| 2-11 | 2I | 80 | 8 | B, M | 20 | 460 | 610 | 35 | 21350 | 695 | 760 | 235 | 150 | 135 | EXAMPLE |
| 2-12 | 2J | 79 | 9 | B, M | 21 | 450 | 590 | 36 | 21240 | 660 | 730 | 210 | 140 | 130 | EXAMPLE |
| 2-13 | 2K | 80 | 9 | B, M | 20 | 460 | 600 | 35 | 21000 | 670 | 750 | 200 | 150 | 140 | EXAMPLE |
| 2-14 | 2L | 81 | 8 | B, M | 19 | 470 | 620 | 34 | 21080 | 670 | 780 | 200 | 160 | 135 | EXAMPLE |

*F: FERRITE,

TABLE 6-continued

| STEEL SHEET NO. | STEEL NO. | MICROSTRUCTURE: PRIMARY PHASE F VOLUME RATIO % | SECONDARY PHASE A VOLUME RATIO % | SECONDARY PHASE OTHER PHASES KIND* | SECONDARY PHASE VOLUME RATIO % | HOT-ROLLED SHEET PROPERTIES TENSILE PROPERTIES YS (MPa) | TS (MPa) | El % | TS × El MPa % | PROPERTIES AFTER PRE-DEFORMATION - HEAT TREATMENT $YS_{HT}$ MPa | $TS_{HT}$ MPa | STRAIN AGE HARDENING PROPERTIES ΔYS MPa | ΔTS MPa | HOLE EXPANSION HOLE EXPANDING RATIO λ % | REMARKS |
|---|---|---|---|---|---|---|---|---|---|---|---|---|---|---|---|

A: AUSTENITE,
M: MARTENSITE,
P: PEARLITE,
B: BAINITE

All Examples according to the present invention showed a high elongation El, a high strength-ductility balance (TS× El) having excellent press formatility, and further showed a very large ΔTS, suggesting that these samples had excellent strain age hardenability. Comparative Examples outside the scope of the present invention, in contrast, suggest that the samples had a low elongation El, a low ΔTS, and decreased press formability and strain age hardenability.

TABLE 7

| STEEL NO. | C | Si | Mn | P | S | Al | N | Cu | Ni | Cr | Mo | Nb | Ti | V | TRANSFORMATION POINT (° C.) Ac1 | Ac3 |
|---|---|---|---|---|---|---|---|---|---|---|---|---|---|---|---|---|
| | COMPOSITION (wt. %) | | | | | | | | | | | | | | | |
| 3A | 0.10 | 1.20 | 1.42 | 0.01 | 0.003 | 0.032 | 0.002 | 1.51 | — | — | — | — | — | — | 725 | 875 |
| 3B | 0.11 | 1.10 | 1.51 | 0.01 | 0.002 | 0.033 | 0.002 | 1.45 | 0.63 | — | 0.11 | — | — | — | 715 | 875 |
| 3C | 0.11 | 1.32 | 1.33 | 0.01 | 0.004 | 0.025 | 0.002 | 1.20 | 0.52 | 0.12 | — | — | — | — | 725 | 880 |
| 3D | 0.10 | 1.06 | 1.48 | 0.01 | 0.003 | 0.022 | 0.002 | 1.39 | 0.43 | — | — | 0.01 | 0.01 | 0.01 | 720 | 870 |
| 3E | 0.09 | 1.25 | 1.36 | 0.01 | 0.004 | 0.029 | 0.002 | 0.22 | — | — | — | — | — | — | 730 | 860 |
| 3F | 0.10 | 1.08 | 1.45 | 0.01 | 0.001 | 0.030 | 0.002 | 0.75 | — | — | — | — | — | — | 720 | 880 |
| 3G | 0.11 | 1.15 | 1.52 | 0.01 | 0.002 | 0.033 | 0.002 | 0.96 | — | — | — | — | — | — | 725 | 875 |
| 3H | 0.10 | 1.10 | 1.55 | 0.01 | 0.002 | 0.025 | 0.002 | 1.22 | 0.66 | — | — | — | — | — | 730 | 875 |
| 3I | 0.11 | 1.09 | 1.48 | 0.01 | 0.001 | 0.033 | 0.002 | 1.36 | — | — | 0.10 | — | — | — | 725 | 860 |
| 3J | 0.11 | 1.12 | 1.62 | 0.01 | 0.002 | 0.029 | 0.001 | 1.42 | — | 0.10 | — | — | — | — | 730 | 880 |
| 3K | 0.10 | 1.25 | 1.39 | 0.01 | 0.002 | 0.032 | 0.002 | 1.38 | — | — | — | 0.01 | — | — | 720 | 870 |
| 3L | 0.09 | 1.10 | 1.45 | 0.01 | 0.003 | 0.025 | 0.002 | 1.29 | — | — | — | — | 0.01 | — | 725 | 865 |
| 3M | 0.10 | 1.35 | 1.50 | 0.01 | 0.002 | 0.030 | 0.002 | 1.44 | — | — | — | — | — | 0.01 | 730 | 875 |
| 3N | 0.11 | 1.26 | 1.46 | 0.01 | 0.001 | 0.028 | 0.001 | 1.33 | 0.52 | 0.12 | 0.11 | 0.01 | 0.01 | 0.01 | 725 | 865 |

Example 3

Molten steels having the composition shown in Table 7 were made in a converter and cast into steel slabs by a continuous casting process. Then, each of these steel slabs was reheated to 1,250° C., and hot-rolled in a hot rolling step of hot rolling at a finish rolling end temperature of 900° C. and a coiling temperature of 600° C. into a hot-rolled steel strip (hot-rolled sheet) having a thickness of 4.0 mm. Then, the hot-rolled steel strip (hot-rolled sheet) was subjected to a cold rolling step of pickling and cold-rolling into cold rolled steel strip (cold-rolled sheet) having a thickness of 1.2 mm. Thereafter, the cold-rolled steel strip (cold-rolled sheet) was subjected to recrystallization annealing step comprising heating and soaking treatment and a subsequent retaining treatment under the conditions shown in Table 8 on the continuous annealing line to obtain cold-rolled annealed sheet. The resultant steel strip (cold-rolled annealed sheet) was further temper-rolled at an reduction of 0.8%.

A test piece was sampled from the resultant steel strip, and the microstructure, tensile properties, the strain age hardenability, and the hole expanding property were investigated, as in Example 1. The press formability was evaluated in terms of the elongation El (ductility), strength-elongation balance TS×El, and the hole expanding ratio, as in Example 1.

(1) Microstructure

A test piece was sampled from each of the resultant steel sheets, and the microstructure of the cross-section (section L) in the rolling direction of the steel sheet was observed with an optical microscope and a scanning electron microscope. The volume ratios of the ferrite, bainite, and martensite phases in the steel sheet were determined, as in Example 1, by image analysis using a photograph of the cross-sectional structure at a magnification of 1,000. The amount of the retained austenite was determined, as in Example 1, by polishing the steel sheet to the central plane in the thickness direction and by measuring diffraction X-ray intensities at the central plane. The incident X-ray, the planes of the ferrite phase, and the planes of retained austenite used were the same as those in Example 1.

(2) Tensile Properties

JIS No. 5 tensile test pieces were sampled from the resultant steel strips in the direction perpendicular to the rolling direction, and a tensile test was carried out, as in Example 1, in accordance with JIS Z 2241 to determine yield strength YS, tensile strength TS, and elongation El.

(3) Strain Age Hardenability

JIS No. 5 test pieces were sampled in the direction perpendicular to the rolling direction from the resultant steel strips (cold-rolled annealed sheets). A plastic deformation of 5% was applied as a pre-deformation (tensile prestrain), as in Example 1. After a heat treatment at 250° C. for 20 minutes, a tensile test was carried out to determine tensile properties (yield stress $YS_{HT}$, and tensile strength $TS_{HT}$) and to calculate $\Delta YS=YS_{HT}-YS$, and $\Delta TS=TS_{HT}-TS$, wherein $YS_{HT}$ and $TS_{HT}$ were yield stress and tensile strength after the pre-deformation—heat treatment, and YS and TS were yield stress and tensile strength of the steel strips (cold-rolled annealed sheets).

(4) Hole Expanding Property

A hole was formed by punching a test piece sampled from the resultant steel strip in accordance with Japan Iron and Steel Federation Standard JFS T 1001-1996 with a punch having a diameter of 10 mm. Then, the hole was expanded with a conical punch having a vertical angle of 60° so that burrs were produced on the outside until cracks passing through the thickness form, thereby determining the hole expanding ratio λ, as in Example 1.

The results are shown in Table 9.

TABLE 9

| STEEL SHEET NO. | STEEL NO. | MICROSTRUCTURE: FERRITE VOLUME RATIO (%) | SECONDARY PHASE: KIND | SECONDARY PHASE: RETAINED AUSTENITE VOLUME RATIO % | SECONDARY PHASE: VOLUME RATIO (%) | COLD-ROLLED SHEET PROPERTIES TENSILE PROPERTIES: YS (MPa) | TS (MPa) | EI (%) | TS × EI |
|---|---|---|---|---|---|---|---|---|---|
| 3-1 | 3A | 90 | A, B | 6 | 10 | 475 | 630 | 34 | 21420 |
| 3-2 | 3B | 92 | A, B | 5 | 8 | 500 | 660 | 32 | 21120 |
| 3-3 | | 0 | P, B, M | 0 | 100 | 690 | 730 | 11 | 8030 |
| 3-4 | | 100 | — | 0 | 0 | 650 | 670 | 11 | 7370 |
| 3-5 | 3C | 92 | A, B | 5 | 8 | 490 | 650 | 33 | 21450 |
| 3-6 | 3D | 91 | A, B | 5 | 9 | 500 | 670 | 32 | 21440 |
| 3-7 | 3E | 93 | A, B | 3 | 7 | 400 | 530 | 40 | 21200 |
| 3-8 | 3F | 94 | A, B | 4 | 6 | 450 | 590 | 36 | 21240 |
| 3-9 | 3G | 93 | A, B | 5 | 7 | 460 | 610 | 35 | 21350 |
| 3-10 | 3H | 90 | A, B | 6 | 10 | 465 | 620 | 34 | 21080 |
| 3-11 | 3I | 92 | A, B | 5 | 8 | 460 | 610 | 34 | 20740 |
| 3-12 | 3J | 90 | A, B | 6 | 10 | 500 | 660 | 32 | 21120 |
| 3-13 | 3K | 92 | A, B | 6 | 8 | 480 | 640 | 33 | 21120 |
| 3-14 | 3L | 91 | A, B | 5 | 9 | 470 | 630 | 33 | 20790 |
| 3-15 | 3M | 90 | A, B | 5 | 10 | 475 | 630 | 34 | 21420 |
| 3-15 | 3N | 92 | A, B | 4 | 8 | 460 | 610 | 34 | 20740 |
| 3-17 | 3A | 90 | P | 0 | 10 | 510 | 600 | 28 | 16800 |
| 3-18 | | 91 | B | 0 | 9 | 540 | 630 | 25 | 15750 |
| 3-19 | | 90 | M | 0 | 10 | 420 | 650 | 27 | 17550 |
| 3-20 | | 92 | M | 0 | 8 | 430 | 640 | 28 | 17920 |

| STEEL SHEET NO. | STEEL NO. | PROPERTIES AFTER PRE-DEFORMATION - HEAT TREATMENT: $YS_{HT}$ (MPa) | $TS_{HT}$ (MPa) | STRAIN AGE HARDENING PROPERTIES: ΔYS (MPa) | ΔTS (MPa) | HOLE EXPANSION HOLE EXPANDING RATIO λ % | REMARKS |
|---|---|---|---|---|---|---|---|
| 3-1 | 3A | 710 | 790 | 235 | 160 | 140 | EXAMPLE |
| 3-2 | 3B | 750 | 830 | 250 | 170 | 135 | EXAMPLE |
| 3-3 | | 740 | 760 | 50 | 30 | 60 | COMP. EX. |
| 3-4 | | 690 | 695 | 40 | 25 | 130 | COMP. EX. |
| 3-5 | 3C | 730 | 810 | 240 | 160 | 135 | EXAMPLE |
| 3-6 | 3D | 750 | 825 | 250 | 155 | 130 | EXAMPLE |
| 3-7 | 3E | 500 | 550 | 100 | 20 | 50 | COMP. EX. |
| 3-8 | 3F | 670 | 740 | 220 | 150 | 145 | EXAMPLE |
| 3-9 | 3G | 690 | 765 | 230 | 155 | 140 | EXAMPLE |
| 3-10 | 3H | 700 | 780 | 235 | 160 | 130 | EXAMPLE |
| 3-11 | 3I | 705 | 780 | 245 | 170 | 135 | EXAMPLE |
| 3-12 | 3J | 740 | 820 | 240 | 160 | 130 | EXAMPLE |
| 3-13 | 3K | 730 | 810 | 250 | 170 | 130 | EXAMPLE |
| 3-14 | 3L | 720 | 795 | 250 | 165 | 135 | EXAMPLE |
| 3-15 | 3M | 715 | 790 | 240 | 160 | 140 | EXAMPLE |
| 3-15 | 3N | 705 | 780 | 245 | 170 | 130 | EXAMPLE |
| 3-17 | 3A | 590 | 650 | 80 | 50 | 70 | COMP. EX. |
| 3-18 | | 605 | 670 | 65 | 40 | 120 | COMP. EX. |

TABLE 9-continued

| | | | | | | |
|---|---|---|---|---|---|---|
| 3-19 | 725 | 805 | 305 | 155 | 125 | COMP. EX. |
| 3-20 | 720 | 800 | 290 | 160 | 120 | COMP. EX. |

F: FERRITE,
A: RETAINED AUSTENITE,
M: MARTENSITE,
P: PEARLITE,
B: BAINITE

All Examples according to the present invention are cold-rolled steel sheets having a high elongation El, a high strength-elongation balance TS×El, a high hole expanding ratio λ, and excellent press formability including stretch flanging formability. In addition, Examples according to the present invention each show a very large ΔTS, suggesting that the samples have excellent strain age hardenability. Comparative Examples outside the scope of the present invention, in contrast, suggest that the samples each have a low elongation El, a low TS×El, a small hole expanding ratio λ, a low ΔTS, and decreased press formability and strain age hardenability.

Example 4

Molten steels having the compositions shown in Table 10 were made in a converter and cast into steel slabs by a continuous casting process. Each of these steel slabs were reheated to 1,250° C., and hot-rolled by a hot rolling step of hot rolling with a finish rolling end temperature of 900° C. and a coiling temperature of 600° C. into a hot-rolled steel strip (hot-rolled sheet) having a thickness of 4.0 mm. Then, the hot-rolled steel strip (hot-rolled sheet) was subjected to a cold rolling step of pickling and cold-rolling into a cold rolled steel strip (cold-rolled sheet) having a thickness of 1.2 mm. Thereafter, the cold-rolled steel strip (cold-rolled sheet) was subjected to recrystallization annealing step comprising a heating and soaking treatment and a subsequent retaining treatment under the conditions shown in Table 11 on a continuous annealing line to obtain cold-rolled annealed sheet. The resultant steel strip (cold-rolled annealed sheet) was further temper-rolled at an reduction of 0.8%.

TABLE 10

| STEEL | COMPOSITION (wt. %) | | | | | | | | | | | | | TRANSFORMATION POINT (° C.) | |
|---|---|---|---|---|---|---|---|---|---|---|---|---|---|---|---|
| NO. | C | Si | Mn | P | S | Al | N | Mo | Cr | W | Nb | Ti | V | Ac1 | Ac3 |
| 4A | 0.10 | 1.21 | 1.45 | 0.01 | 0.003 | 0.032 | 0.002 | 0.45 | 0.15 | — | — | — | — | 740 | 880 |
| 4B | 0.11 | 1.12 | 1.52 | 0.01 | 0.002 | 0.032 | 0.002 | 0.32 | — | — | 0.04 | — | 0.05 | 735 | 875 |
| 4C | 0.11 | 1.30 | 1.35 | 0.01 | 0.003 | 0.028 | 0.002 | 0.48 | — | — | 0.05 | 0.03 | — | 740 | 885 |
| 4D | 0.10 | 1.05 | 1.50 | 0.01 | 0.004 | 0.033 | 0.002 | — | — | 0.54 | — | — | — | 735 | 875 |
| 4E | 0.09 | 1.26 | 1.38 | 0.01 | 0.004 | 0.032 | 0.002 | 0.35 | — | — | — | 0.05 | — | 735 | 880 |
| 4F | 0.10 | 1.10 | 1.48 | 0.01 | 0.003 | 0.031 | 0.002 | — | 0.50 | — | 0.05 | — | — | 730 | 885 |
| 4G | 0.11 | 1.16 | 1.53 | 0.01 | 0.004 | 0.032 | 0.002 | — | — | — | — | — | — | 725 | 830 |
| 4H | 0.12 | 1.20 | 1.52 | 0.01 | 0.002 | 0.028 | 0.002 | 0.35 | — | — | — | — | — | 740 | 870 |
| 4I | 0.10 | 1.18 | 1.45 | 0.01 | 0.002 | 0.030 | 0.002 | — | 0.25 | — | — | — | — | 735 | 860 |
| 4J | 0.11 | 1.10 | 1.36 | 0.01 | 0.003 | 0.031 | 0.002 | 0.45 | — | — | — | — | | 730 | 860 |
| 4K | 0.12 | 1.15 | 1.45 | 0.01 | 0.001 | 0.025 | 0.002 | 0.30 | — | — | 0.03 | 0.01 | 0.01 | 735 | 850 |
| 4L | 0.11 | 1.08 | 1.50 | 0.01 | 0.003 | 0.032 | 0.002 | 0.25 | 0.15 | 0.10 | — | — | — | 740 | 865 |

TABLE 11

| STEEL | | HOT ROLLING STEP | | | | RECRYSTALLIZATION ANNEALING STEP | | |
|---|---|---|---|---|---|---|---|---|
| SHEET NO. | STEEL NO. | SLAB REHEATING TEMP. (° C.) | FINISH ROLLING END TEMP. FDT ° C. | COILING TEMP. CT ° C. | COLD ROLLING STEP COLD ROLLING REDUCTION % | HEATING SOAKING TREATMENT HEATING SOAKING TEMP. (° C.) | RETAINING TREATMENT TEMP (° C.) | RETAINING TREATMENT RETENTION TIME (s) |
| 4-1 | 4A | 1250 | 900 | 600 | 70 | 800 | 400 | 300 |
| 4-2 | 4B | 1250 | 900 | 600 | 70 | 800 | 400 | 300 |
| 4-3 | | 1250 | 900 | 600 | 70 | 980 | — | — |
| 4-4 | | 1250 | 900 | 600 | 70 | 680 | 400 | 300 |
| 4-5 | 4C | 1250 | 900 | 600 | 70 | 800 | 400 | 300 |
| 4-6 | 4D | 1250 | 900 | 600 | 70 | 800 | 400 | 300 |
| 4-7 | 4E | 1250 | 900 | 600 | 70 | 800 | 400 | 300 |
| 4-8 | 4F | 1250 | 900 | 600 | 70 | 800 | 400 | 300 |
| 4-9 | 4G | 1250 | 900 | 600 | 70 | 800 | 400 | 300 |
| 4-10 | 4H | 1250 | 900 | 600 | 70 | 800 | 400 | 300 |

TABLE 11-continued

| STEEL | | HOT ROLLING STEP | | | | RECRYSTALLIZATION ANNEALING STEP | | |
|---|---|---|---|---|---|---|---|---|
| | | SLAB REHEATING | FINISH ROLLING END TEMP. | COILING TEMP. | COLD ROLLING STEP COLD ROLLING | HEATING SOAKING TREATMENT HEATING | RETAINING TREATMENT | |
| SHEET NO. | STEEL NO. | TEMP. (° C.) | FDT ° C. | CT ° C. | REDUCTION % | SOAKING TEMP. (° C.) | TEMP (° C.) | RETENTION TIME (s) |
| 4-11 | 4I | 1250 | 900 | 600 | 70 | 800 | 400 | 300 |
| 4-12 | 4J | 1250 | 900 | 600 | 70 | 800 | 400 | 300 |
| 4-13 | 4K | 1250 | 900 | 600 | 70 | 800 | 400 | 300 |
| 4-14 | 4L | 1250 | 900 | 600 | 70 | 800 | 400 | 300 |
| 4-15 | 4A | 1250 | 900 | 600 | 70 | 800 | 250 | 300 |
| 4-16 | | 1250 | 900 | 600 | 70 | 800 | 550 | 300 |

A test piece was sampled from the resultant steel strip, and the microstructure, the tensile properties, the strain age hardenability, and the hole expanding property were investigated, as in Example 3.

The results are shown in Table 12.

TABLE 12

| STEEL | | MICROSTRUCTURE | | | | COLD-ROLLED | | | |
|---|---|---|---|---|---|---|---|---|---|
| | | FERRITE | SECONDARY PHASE | | | | | | |
| | | | | RETAINED AUSTENITE | | SHEET PROPERTIES TENSILE PROPERTIES | | | |
| STEEL | | VOLUME | | | VOLUME | | | | |
| SHEET NO. | STEEL NO. | RATIO (%) | KIND | VOLUME RATIO % | RATIO (%) | YS (MPa) | TS (MPa) | EI (%) | TS × EI |
| 4-1 | 4A | 91 | A, B | 6 | 9 | 470 | 630 | 34 | 21420 |
| 4-2 | 4B | 92 | A, B | 5 | 8 | 500 | 660 | 32 | 21120 |
| 4-3 | | 0 | P, B, M | 0 | 100 | 560 | 740 | 12 | 8880 |
| 4-4 | | 100 | — | 0 | 0 | 500 | 660 | 11 | 7260 |
| 4-5 | 4C | 92 | A, B | 5 | 8 | 480 | 640 | 33 | 21120 |
| 4-6 | 4D | 94 | A, B | 4 | 6 | 470 | 630 | 34 | 21420 |
| 4-7 | 4E | 92 | A, B | 5 | 8 | 490 | 650 | 33 | 21450 |
| 4-8 | 4F | 93 | A, B | 4 | 7 | 470 | 620 | 34 | 21080 |
| 4-9 | 4G | 94 | A, B | 3 | 6 | 460 | 620 | 34 | 21080 |
| 4-10 | 4H | 92 | A, B | 5 | 8 | 475 | 630 | 33 | 20790 |
| 4-11 | 4I | 90 | A, B | 4 | 10 | 480 | 640 | 33 | 21120 |
| 4-12 | 4J | 91 | A, B | 5 | 9 | 485 | 650 | 32 | 20800 |
| 4-13 | 4K | 92 | A, B | 4 | 8 | 470 | 630 | 34 | 21420 |
| 4-14 | 4L | 90 | A, B | 5 | 10 | 465 | 620 | 34 | 21080 |
| 4-15 | 4A | 93 | M | 0 | 7 | 380 | 630 | 28 | 17640 |
| 4-16 | | 92 | P | 0 | 8 | 550 | 650 | 24 | 15600 |

| STEEL SHEET | STEEL | PROPERTIES AFTER PRE-DEFORMATION - HEAT TREATMENT | | STRAIN AGE HARDENING PROPERTIES | | HOLE EXPANSION HOLE EXPANDING | |
|---|---|---|---|---|---|---|---|
| NO. | NO. | $YS_{HT}$ (MPa) | $TS_{HT}$ (MPa) | ΔYS (MPa) | ΔTS (MPa) | RATIO λ% | REMARKS |
| 4-1 | 4A | 700 | 780 | 230 | 150 | 140 | EXAMPLE |
| 4-2 | 4B | 740 | 820 | 240 | 160 | 130 | EXAMPLE |
| 4-3 | | 680 | 760 | 120 | 20 | 60 | COMP. EX. |
| 4-4 | | 610 | 675 | 110 | 15 | 130 | COMP. EX. |
| 4-5 | 4C | 710 | 790 | 230 | 150 | 120 | EXAMPLE |
| 4-6 | 4D | 700 | 775 | 230 | 145 | 130 | EXAMPLE |
| 4-7 | 4E | 720 | 800 | 230 | 150 | 120 | EXAMPLE |
| 4-8 | 4F | 680 | 760 | 210 | 140 | 120 | EXAMPLE |
| 4-9 | 4G | 570 | 630 | 110 | 10 | 60 | COMP. EX. |
| 4-10 | 4H | 710 | 790 | 235 | 160 | 130 | EXAMPLE |
| 4-11 | 4I | 725 | 805 | 245 | 165 | 120 | EXAMPLE |
| 4-12 | 4J | 730 | 810 | 245 | 160 | 120 | EXAMPLE |
| 4-13 | 4K | 710 | 790 | 240 | 160 | 130 | EXAMPLE |
| 4-14 | 4L | 700 | 775 | 235 | 155 | 120 | EXAMPLE |

TABLE 12-continued

| | | | | | | | |
|---|---|---|---|---|---|---|---|
| 4-15 | 4A | 710 | 790 | 330 | 160 | 110 | COMP. EX. |
| 4-16 | | 620 | 680 | 70 | 30 | 70 | COMP. EX. |

F: FERRITE,
A: RETAINED AUSTENITE,
M: MARTENSITE,
P: PEARLITE,
B: BAINITE

All Examples according to the present invention show a high elongation El, a high strength-ductility balance TS×El, and a high hole expanding ratio λ, suggesting that the samples have excellent press formability including stretch flanging formability. In addition, Examples according to the present invention show a very large ΔTS, suggesting that the samples have excellent strain age hardenability. Comparative Examples outside the scope of the present invention, in contrast, suggest that the samples have a low elongation El, a low TS×El, a small hole expanding ratio λ, a low ΔTS, and decreased press formability and strain age hardenability.

Example 5

Molten steels having the compositions shown in Table 13 were made in a converter and cast into steel slabs by a continuous casting process. These slabs were hot-rolled under the conditions shown in Table 14 into hot-rolled steel strips (hot-rolled sheets).

After pickling, each of these hot-rolled steel strips (hot-rolled sheets) was subjected to a primary heat treatment step on a continuous annealing line (CAL) under the conditions shown in Table 14 and a secondary heat treatment step on a continuous hot-dip galvanizing line (CGL) under the conditions shown in Table 14. Then, the sheet was subjected to a hot-dip galvanizing treatment step of performing a hot-dip galvanizing which forms a hot-dip galvanizing layer on the surfaces of the steel sheet. Then, an alloying treatment step of alloying the hot-dip galvanizing layer was applied under the conditions shown in Table 14. Some of the steel sheets were left as hot-dip galvanized.

After further pickling, the hot-rolled steel strip (hot-rolled sheet) obtained by the above-mentioned hot rolling was subjected to a cold rolling step under the conditions shown in Table 14 into a cold-rolled steel strip (cold-rolled sheet). Then, the cold-rolled steel strip (cold-rolled sheet) was subjected to a primary heat treatment step on a continuous annealing line (CAL) under the conditions shown in Table 14. After a secondary heat treatment step on the continuous hot-dip galvanizing line (CGL) under the conditions shown in Table 14, a hot-dip galvanizing treatment step was performed. Then, an alloying treatment step was performed under the conditions shown in Table 14. Some of the steel sheets were left as hot-dip galvanized.

Prior to the secondary heat treatment step on the continuous hot-dip galvanizing line (CGL), some of the steel sheets after the primary heat treatment step were subjected to a pickling treatment shown in Table 14. The pickling treatment was carried out in a pickling bath on the entry side of the CGL.

The galvanizing bath temperature was within the range of 460 to 480° C., and the temperature of the steel sheet to be dipped was within the range of the galvanizing bath temperature to (bath temperature+10° C.). In the alloying treatment, the sheet was reheated within the temperature range of 480 to 540° C., and held at the temperature for 15 to 28 seconds. The cooling rate after the alloying treatment was 10° C./second. The plated steel sheet was further temper rolled at a reduction of 1.0%.

TABLE 13

| STEEL | COMPOSITION (wt. %) | | | | | | | | | | | TRANSFORMATION POINT (° C.) | |
|---|---|---|---|---|---|---|---|---|---|---|---|---|---|
| NO. | C | Si | Mn | P | S | Al | N | Cu | Ni | Cr, Mo | Nb, Ti, V | Ac1 | Ac3 |
| 5A | 0.08 | 0.72 | 2.05 | 0.01 | 0.003 | 0.032 | 0.002 | 1.48 | — | — | — | 715 | 875 |
| 5B | 0.07 | 0.52 | 2.22 | 0.01 | 0.001 | 0.033 | 0.002 | 1.44 | 0.62 | Mo: 0.15 | — | 720 | 870 |
| 5C | 0.09 | 0.77 | 1.85 | 0.01 | 0.004 | 0.028 | 0.002 | 1.28 | 0.55 | Cr: 0.15 | — | 725 | 875 |
| 5D | 0.08 | 0.65 | 1.95 | 0.01 | 0.005 | 0.032 | 0.002 | 1.33 | 0.42 | — | Nb: 0.01, Ti: 0.01, V: 0.01 | 715 | 870 |
| 5E | 0.07 | 0.55 | 2.05 | 0.01 | 0.004 | 0.033 | 0.002 | 0.14 | — | — | — | 715 | 875 |
| 5F | 0.08 | 0.70 | 2.22 | 0.01 | 0.003 | 0.033 | 0.002 | 0.72 | — | — | — | 715 | 870 |
| 5G | 0.07 | 0.68 | 1.85 | 0.01 | 0.005 | 0.036 | 0.002 | 0.95 | — | — | — | 715 | 875 |
| 5H | 0.08 | 0.77 | 2.05 | 0.01 | 0.003 | 0.032 | 0.002 | 1.45 | 0.75 | — | — | 715 | 870 |
| 5I | 0.09 | 0.80 | 1.85 | 0.01 | 0.002 | 0.028 | 0.002 | 1.29 | — | Cr: 0.12 | — | 720 | 875 |
| 5J | 0.07 | 0.75 | 2.05 | 0.01 | 0.005 | 0.030 | 0.002 | 1.38 | — | Mo: 0.15 | — | 715 | 870 |
| 5K | 0.08 | 0.68 | 1.95 | 0.01 | 0.003 | 0.025 | 0.002 | 1.40 | — | — | Nb: 0.01 | 720 | 875 |
| 5L | 0.07 | 0.70 | 2.10 | 0.01 | 0.004 | 0.030 | 0.002 | 1.35 | — | — | Ti: 0.01 | 715 | 870 |
| 5M | 0.08 | 0.75 | 1.80 | 0.01 | 0.002 | 0.031 | 0.002 | 1.25 | — | — | V: 0.01 | 725 | 870 |
| 5N | 0.09 | 0.68 | 2.00 | 0.01 | 0.003 | 0.035 | 0.002 | 1.35 | 0.60 | Cr: 0.13, Mo: 0.15 | Nb: 0.01, V: 0.01 | 710 | 875 |

TABLE 14

| | | | HOT ROLLING STEP | | | COLD ROLLING STEP | | PRIMARY HEAT TREATMENT STEP | | |
|---|---|---|---|---|---|---|---|---|---|---|
| STEEL SHEET NO. | STEEL NO. | SLAB REHEATING TEMP. (° C.) | FINISH ROLLING END TEMP. FDT ° C. | COILING TEMP. CT ° C. | FINAL THICK-NESS mm | COLD ROLLING REDUCTION % | FINAL THICK-NESS mm | LINE | HEATING TEMP. ° C. | COOLING RATE ° C./s |
| 5-1 | 5A | 1250 | 850 | 600 | 1.2 | — | — | CAL | 880 | 20 |
| 5-2 | 5B | 1250 | 850 | 600 | 1.2 | — | — | CAL | 880 | 20 |
| 5-3 | | | | | | | | | | |
| 5-4 | | | | | | | | | | |
| 5-5 | | | | | | | | | | |
| 5-6 | 5C | 1250 | 850 | 600 | 1.2 | — | — | CAL | 880 | 20 |
| 5-7 | 5D | 1250 | 850 | 600 | 1.2 | — | — | CAL | 880 | 20 |
| 5-8 | 5E | 1250 | 850 | 600 | 1.2 | — | — | CAL | 880 | 20 |
| 5-9 | 5F | 1250 | 850 | 600 | 1.2 | — | — | CAL | 880 | 20 |
| 5-10 | 5G | 1250 | 850 | 600 | 1.2 | — | — | CAL | 880 | 20 |
| 5-11 | 5A | 1250 | 850 | 600 | 4.0 | 70 | 1.2 | CAL | 880 | 20 |
| 5-12 | 5B | 1250 | 850 | 600 | 4.0 | 70 | 1.2 | CAL | 880 | 20 |
| 5-13 | | | | | | | | CAL | 880 | 20 |
| 5-14 | | | | | | | | CAL | 880 | 20 |
| 5-15 | | | | | | | | CAL | 880 | 20 |
| 5-16 | 5C | 1250 | 850 | 600 | 4.0 | 70 | 1.2 | CAL | 880 | 20 |
| 5-17 | 5D | 1250 | 850 | 600 | 4.0 | 70 | 1.2 | CAL | 880 | 20 |
| 5-18 | 5E | 1250 | 850 | 600 | 4.0 | 70 | 1.2 | CAL | 880 | 20 |
| 5-19 | 5F | 1250 | 850 | 600 | 4.0 | 70 | 1.2 | CAL | 880 | 20 |
| 5-20 | 5G | 1250 | 850 | 600 | 4.0 | 70 | 1.2 | CAL | 880 | 20 |
| 5-21 | 5H | 1250 | 850 | 600 | 4.0 | 70 | 1.2 | CAL | 880 | 20 |
| 5-22 | 5I | 1250 | 850 | 600 | 4.0 | 70 | 1.2 | CAL | 880 | 20 |
| 5-23 | 5J | 1250 | 850 | 600 | 4.0 | 70 | 1.2 | CAL | 880 | 20 |
| 5-24 | 5K | 1250 | 850 | 600 | 4.0 | 70 | 1.2 | CAL | 880 | 20 |
| 5-25 | 5L | 1250 | 850 | 600 | 4.0 | 70 | 1.2 | CAL | 880 | 20 |
| 5-26 | 5M | 1250 | 850 | 600 | 4.0 | 70 | 1.2 | CAL | 880 | 20 |
| 5-27 | 5N | 1250 | 850 | 600 | 4.0 | 70 | 1.2 | CAL | 880 | 20 |

| | | | SECONDARY HEAT TREATMENT STEP | | | HOT-DIP GALVANIZING | | | | |
|---|---|---|---|---|---|---|---|---|---|---|
| STEEL SHEET NO. | STEEL NO. | PICK-LING TREAT-MENT | KIND OF LINE | HEAT-ING TEMP. ° C. | COOL-ING RATE* ° C./s | KIND OF LINE | COOLING RATE AFTER GALVA-NIZING** ° C./s | ALLOYING TREATMENT STEP | TEMP ° C. | TEMPER ROLLING REDUCTION % |
| 5-1 | 5A | YES | CGL | 800 | 20 | CGL | 10 | ALLOYING | 500 | 1.0 |
| 5-2 | 5B | — | CGL | 800 | 20 | CGL | 10 | ALLOYING | 500 | 1.0 |
| 5-3 | | YES | CGL | 780 | 20 | CGL | 10 | ALLOYING | 500 | 1.0 |
| 5-4 | | | CGL | 980 | 20 | CGL | 10 | ALLOYING | 500 | 1.0 |
| 5-5 | | | CGL | 650 | 20 | CGL | 10 | ALLOYING | 500 | 1.0 |
| 5-6 | 5C | YES | CGL | 800 | 20 | CGL | 10 | ALLOYING | 500 | 1.0 |
| 5-7 | 5D | YES | CGL | 820 | 20 | CGL | 10 | ALLOYING | 500 | 1.0 |
| 5-8 | 5E | YES | CGL | 800 | 20 | CGL | 10 | ALLOYING | 500 | 1.0 |
| 5-9 | 5F | YES | CGL | 780 | 20 | CGL | 10 | NON-ALLOYING | — | 1.0 |
| 5-10 | 5G | YES | CGL | 800 | 20 | CGL | 10 | ALLOYING | 500 | 1.0 |
| 5-11 | 5A | YES | CGL | 800 | 20 | CGL | 10 | ALLOYING | 500 | 1.0 |
| 5-12 | 5B | — | CGL | 820 | 20 | CGL | 10 | ALLOYING | 500 | 1.0 |
| 5-13 | | YES | CGL | 800 | 20 | CGL | 10 | ALLOYING | 500 | 1.0 |
| 5-14 | | YES | CGL | 980 | 20 | CGL | 10 | ALLOYING | 500 | 1.0 |
| 5-15 | | YES | CGL | 680 | 20 | CGL | 10 | ALLOYING | 500 | 1.0 |
| 5-16 | 5C | YES | CGL | 800 | 20 | CGL | 10 | ALLOYING | 500 | 1.0 |
| 5-17 | 5D | YES | CGL | 800 | 20 | CGL | 10 | NON-ALLOYING | — | 1.0 |
| 5-18 | 5E | YES | CGL | 780 | 20 | CGL | 10 | ALLOYING | 500 | 1.0 |
| 5-19 | 5F | YES | CGL | 800 | 20 | CGL | 10 | ALLOYING | 500 | 1.0 |
| 5-20 | 5G | YES | CGL | 820 | 20 | CGL | 10 | ALLOYING | 500 | 1.0 |
| 5-21 | 5H | YES | CGL | 800 | 20 | CGL | 10 | ALLOYING | 500 | 1.0 |
| 5-22 | 5I | YES | CGL | 800 | 20 | CGL | 10 | ALLOYING | 500 | 1.0 |
| 5-23 | 5J | YES | CGL | 800 | 20 | CGL | 10 | ALLOYING | 500 | 1.0 |
| 5-24 | 5K | YES | CGL | 800 | 20 | CGL | 10 | ALLOYING | 500 | 1.0 |
| 5-25 | 5L | YES | CGL | 800 | 20 | CGL | 10 | ALLOYING | 500 | 1.0 |

TABLE 14-continued

| | | | | | | | | | | |
|---|---|---|---|---|---|---|---|---|---|---|
| 5-26 | 5M | YES | CGL | 800 | 20 | CGL | 10 | ALLOYING | 500 | 1.0 |
| 5-27 | 5N | YES | CGL | 800 | 20 | CGL | 10 | ALLOYING | 500 | 1.0 |

*COOLING RATE UNTIL 480° C.
**COOLING RATE UNTIL 300° C.

For the hot-dip galvanized steel sheet (steel strip) obtained through the above-mentioned steps, the microstructure, the tensile properties, the strain age hardenability, and the hole expanding ratio were determined, as in Example 1. Press formability was evaluated in terms of elongation El (ductility), and hole expanding ratio.

(1) Microstructure

The microstructure of the cross-section (section L) in the rolling direction of the steel sheet was observed with an optical microscope and a scanning electron microscope. The volume ratios of the ferrite phase, lath martensite phase, tempered martensite phase, and martensite phase were determined, as in Example 1, by image analysis using a photograph of cross-sectional structure at a magnification of 1,000. The amount of retained austenite was determined, as in Example 1, by polishing the steel sheet to the central plane in the thickness direction and by measuring diffraction X-ray intensities at the central plane. The incident X-ray, the planes of the ferrite phase, and the planes of retained austenite used were the same as those in Example 1.

(2) Tensile Properties

JIS No. 5 tensile test pieces were sampled from the resultant steel strips in the direction perpendicular to the rolling direction, and a tensile test was carried out in accordance with JIS Z 2241 to determine the yield strength YS, the tensile strength TS, and the elongation El, as in Example 1.

(3) Strain Age Hardenability

JIS No. 5 test pieces were sampled from the resultant steel strips in the direction perpendicular to the rolling direction, and a plastic deformation of 5% was applied as a pre-deformation (tensile prestrain), as in Example 1. After a heat treatment at 250° C. for 20 minutes, a tensile test was carried out to determine tensile properties (yield stress $YS_{TH}$, and tensile strength $TS_{HT}$) and to calculate $\Delta YS=YS_{TH}-YS$, and $\Delta TS=TS_{HT}-TS$, wherein $YS_{TH}$ and $TS_{HT}$ were yield stress and tensile strength after the pre-deformation—heat treatment, and YS and TS were yield stress and tensile strength of the steel strips.

(4) Hole Expanding Ratio

A hole was formed by punching a test piece sampled from the resultant steel strip in accordance with Japan Iron and Steel Federation Standard JFS T 1001-1996 with a punch having a diameter of 10 mm. Then, the hole was expanded with a conical punch having a vertical angle of 60° C. so that burrs were produced on the outside until cracks passing through the thickness form, thereby determining the hole expanding ratio λ, as in Example 1.

The results are shown in Table 15.

TABLE 15

| STEEL | | MICROSTRUCTURE | | | | | | PLATED SHEET PROPERTIES TENSILE PROPERTIES | | | |
|---|---|---|---|---|---|---|---|---|---|---|---|
| | | PRIMARY PHASE | | | SECONDARY PHASE | | | | | | |
| | | FERRITE | TEMPERED MARTENSITE | | | RETAINED AUSTENITE | | | | | |
| SHEET NO. | STEEL NO. | VOLUME RATIO % | VOLUME RATIO % | VOLUME RATIO % | KIND* | VOLUME RATIO % | VOLUME RATIO % | YS (MPa) | TS (MPa) | El (%) | TS × El (Mpa %) |
| 5-1 | 5A | 57 | 35 | 92 | A, B, | 5 | 8 | 470 | 620 | 34 | 21080 |
| 5-2 | 5B | 52 | 40 | 92 | A, B, | 4 | 8 | 480 | 640 | 33 | 21120 |
| 5-3 | | 51 | 40 | 91 | A, B, | 5 | 9 | 470 | 620 | 34 | 21080 |
| 5-4 | | 0 | 0 | 0 | M, P, B | 0 | 100 | 670 | 710 | 11 | 7810 |
| 5-5 | | 60 | 40 | 100 | — | 0 | 0 | 620 | 650 | 12 | 7800 |
| 5-6 | 5C | 58 | 35 | 93 | A, B | 4 | 7 | 470 | 630 | 34 | 21420 |
| 5-7 | 5D | 57 | 35 | 92 | A, B | 5 | 8 | 490 | 650 | 33 | 21450 |
| 5-8 | 5E | 53 | 40 | 93 | A, B | 7 | 7 | 380 | 510 | 42 | 21420 |
| 5-9 | 5F | 37 | 55 | 92 | A, B | 4 | 8 | 430 | 570 | 37 | 21090 |
| 5-10 | 5G | 53 | 40 | 93 | A, B | 5 | 7 | 450 | 590 | 36 | 21240 |
| 5-11 | 5A | 57 | 35 | 92 | A, B | 7 | 8 | 470 | 630 | 34 | 21420 |
| 5-12 | 5B | 52 | 40 | 92 | A, B | 5 | 8 | 500 | 660 | 32 | 21120 |
| 5-13 | | 53 | 40 | 93 | A, B | 6 | 7 | 480 | 640 | 33 | 21120 |
| 5-14 | | 0 | 0 | 0 | M, P, B | 0 | 100 | 680 | 720 | 12 | 8640 |
| 5-15 | | 65 | 35 | 100 | — | 0 | 0 | 620 | 660 | 11 | 7260 |
| 5-16 | 5C | 52 | 40 | 92 | A, B | 4 | 8 | 490 | 650 | 33 | 21450 |
| 5-17 | 5D | 53 | 40 | 93 | A, B | 5 | 7 | 500 | 660 | 32 | 21120 |
| 5-18 | 5E | 48 | 45 | 93 | A, B | 4 | 7 | 390 | 520 | 41 | 21320 |
| 5-19 | 5F | 44 | 50 | 94 | A, B | 5 | 6 | 440 | 580 | 37 | 21460 |
| 5-20 | 5G | 57 | 35 | 92 | A, B | 5 | 8 | 450 | 600 | 35 | 21000 |
| 5-21 | 5H | 51 | 40 | 91 | A, B | 5 | 9 | 445 | 590 | 35 | 20650 |
| 5-22 | 5I | 55 | 35 | 90 | A, B | 5 | 10 | 460 | 610 | 34 | 20740 |
| 5-23 | 5J | 52 | 40 | 92 | A, B | 4 | 8 | 450 | 600 | 35 | 21000 |
| 5-24 | 5K | 53 | 40 | 93 | A, B | 5 | 7 | 470 | 620 | 34 | 21080 |
| 5-25 | 5L | 56 | 35 | 91 | A, B | 6 | 9 | 475 | 630 | 33 | 20790 |
| 5-26 | 5M | 60 | 30 | 90 | A, B | 5 | 10 | 460 | 610 | 34 | 20740 |

TABLE 15-continued

| 5-27 | 5N | 52 | 40 | 92 | A, B | 4 | 8 | 455 | 600 | 35 | 21000 |
|---|---|---|---|---|---|---|---|---|---|---|---|

| STEEL | | PROPERTIES AFTER PRE-DEFORMATION-HEAT TREATMENT | | STRAIN AGE HARDENING PROPERTIES | | HOLE EXPANSION HOLE | |
|---|---|---|---|---|---|---|---|
| SHEET NO. | STEEL NO. | $YS_{HT}$ (MPa) | $TS_{HT}$ (MPa) | ΔYS (MPa) | ΔTS (MPa) | EXPANDING RATIO λ % | REMARKS |
| 5-1 | 5A | 700 | 775 | 230 | 155 | 140 | EXAMPLE |
| 5-2 | 5B | 725 | 805 | 245 | 165 | 135 | EXAMPLE |
| 5-3 | | 710 | 785 | 240 | 165 | 135 | EXAMPLE |
| 5-4 | | 710 | 740 | 40 | 30 | 65 | COMP. EX. |
| 5-5 | | 650 | 675 | 30 | 25 | 130 | COMP. EX. |
| 5-6 | 5C | 710 | 785 | 240 | 155 | 135 | EXAMPLE |
| 5-7 | 5D | 725 | 805 | 235 | 155 | 130 | EXAMPLE |
| 5-8 | 5E | 480 | 530 | 100 | 20 | 60 | COMP. EX. |
| 5-9 | 5F | 650 | 720 | 220 | 150 | 140 | EXAMPLE |
| 5-10 | 5G | 675 | 745 | 225 | 155 | 135 | EXAMPLE |
| 5-11 | 5A | 715 | 790 | 245 | 160 | 145 | EXAMPLE |
| 5-12 | 5B | 750 | 830 | 250 | 170 | 140 | EXAMPLE |
| 5-13 | | 730 | 810 | 250 | 170 | 140 | EXAMPLE |
| 5-14 | | 720 | 750 | 40 | 30 | 70 | COMP. EX. |
| 5-15 | | 650 | 685 | 30 | 25 | 60 | COMP. EX. |
| 5-16 | 5C | 730 | 810 | 240 | 160 | 140 | EXAMPLE |
| 5-17 | 5D | 735 | 815 | 235 | 155 | 135 | EXAMPLE |
| 5-18 | 5E | 490 | 540 | 100 | 20 | 60 | COMP. EX. |
| 5-19 | 5F | 655 | 725 | 215 | 145 | 135 | EXAMPLE |
| 5-20 | 5G | 675 | 750 | 225 | 150 | 140 | EXAMPLE |
| 5-21 | 5H | 680 | 755 | 235 | 165 | 130 | EXAMPLE |
| 5-22 | 5I | 695 | 770 | 235 | 160 | 135 | EXAMPLE |
| 5-23 | 5J | 680 | 755 | 230 | 155 | 130 | EXAMPLE |
| 5-24 | 5K | 710 | 780 | 240 | 160 | 130 | EXAMPLE |
| 5-25 | 5L | 720 | 795 | 245 | 165 | 135 | EXAMPLE |
| 5-26 | 5M | 695 | 770 | 235 | 160 | 130 | EXAMPLE |
| 5-27 | 5N | 680 | 755 | 225 | 155 | 130 | EXAMPLE |

*M: MARTENSITE,
P: PEARLITE,
B: BAINITE,
A: RETAINED AUSTENITE

All Examples according to the present invention each show a high elongation El and a high hole expanding ratio λ, suggesting that the samples are hot-dip galvanized steel sheets having an excellent stretch flanging formability. In addition, Examples according to the present invention showed a very large ΔTS, suggesting that the samples are steel sheets having excellent strain age hardenability. Comparative Examples outside the scope of the invention, in contrast, suggest that the samples are steel sheets having a low elongation El, a small hole expanding ratio λ, a low ΔTS, and decreased press formability and strain age hardenability.

Example 6

Molten steels having the compositions shown in Table 16 was made in a converter and cast into steel slabs by a continuous casting process. Each of these steel slabs were reheated to 1,250° C., and hot-rolled by a hot rolling step of hot rolling with a finish rolling end temperature of 900° C. and a coiling temperature of 600° C. into hot-rolled steel strip (hot-rolled sheet) having a thickness of 4.0 mm. Then, the hot-rolled steel strip (hot-rolled sheet) was subjected to a cold rolling step of pickling and cold-rolling into cold-rolled steel strip (cold-rolled sheet) having a thickness of 1.2 mm. Then, the cold-rolled steel strip (cold-rolled sheet) was subjected to a primary heat treatment step on a continuous annealing line (CAL) under the conditions shown in Table 17. Then, the sheet was subjected to a secondary heat treatment step on a continuous hot-dip galvanizing line (CGL) under the conditions shown in Table 17 and then, subjected to a hot-dip galvanizing treatment step to form a hot-dip galvanizing layer on the surfaces of the steel sheet. In addition, an alloying treatment step was applied under the conditions shown in FIG. 17. The cooling rate after the alloying treatment was 10° C./second. Some of the steel strips (steel sheets) were left as hot-dip galvanized.

TABLE 16

| STEEL | COMPOSITION (wt. %) | | | | | | | | | TRANSFORMATION POINT (° C.) | |
|---|---|---|---|---|---|---|---|---|---|---|---|
| NO. | C | Si | Mn | P | S | Al | N | Cr, Mo, W | Nb, Ti, V | Ac1 | Ac3 |
| 6A | 0.07 | 0.77 | 2.00 | 0.01 | 0.003 | 0.033 | 0.002 | Cr: 0.20, Mo: 0.43 | — | 715 | 870 |

TABLE 16-continued

| STEEL | COMPOSITION (wt. %) | | | | | | | | | TRANSFORMATION POINT (° C.) | |
|---|---|---|---|---|---|---|---|---|---|---|---|
| NO. | C | Si | Mn | P | S | Al | N | Cr, Mo, W | Nb, Ti, V | Ac1 | Ac3 |
| 6B | 0.08 | 0.55 | 2.22 | 0.01 | 0.001 | 0.033 | 0.002 | Mo: 0.33 | Nb: 0.04, V: 0.05 | 720 | 865 |
| 6C | 0.08 | 0.75 | 1.80 | 0.01 | 0.004 | 0.020 | 0.002 | Mo: 0.48 | Nb: 0.05, Ti: 0.03 | 725 | 880 |
| 6D | 0.09 | 0.63 | 1.98 | 0.01 | 0.005 | 0.025 | 0.002 | W: 0.54 | — | 715 | 865 |
| 6E | 0.07 | 0.65 | 2.02 | 0.01 | 0.003 | 0.033 | 0.002 | Mo: 0.36 | Ti: 0.05 | 715 | 875 |
| 6F | 0.08 | 0.70 | 1.90 | 0.01 | 0.005 | 0.035 | 0.002 | Cr: 0.50 | Nb: 0.05 | 715 | 865 |
| 6G | 0.07 | 0.58 | 2.08 | 0.01 | 0.004 | 0.032 | 0.002 | — | — | 715 | 865 |
| 6H | 0.08 | 0.75 | 2.22 | 0.01 | 0.004 | 0.022 | 0.002 | Mo: 0.35 | — | 715 | 870 |
| 6I | 0.08 | 0.77 | 1.98 | 0.01 | 0.003 | 0.032 | 0.002 | Cr: 0.25 | — | 710 | 860 |
| 6J | 0.07 | 0.68 | 2.05 | 0.01 | 0.002 | 0.035 | 0.002 | Mo: 0.15, Cr: 0.10, W: 0.11 | — | 720 | 865 |
| 6K | 0.09 | 0.70 | 1.98 | 0.01 | 0.001 | 0.028 | 0.002 | Mo: 0.25, Cr: 0.10 | V: 0.05 | 715 | 865 |

TABLE 17

| | | | HOT ROLLING STEP | | | COLD ROLLING STEP | | PRIMARY HEAT TREATMENT STEP | | |
|---|---|---|---|---|---|---|---|---|---|---|
| | | SLAB | FINISH ROLLING END | COILING | FINAL | COLD | FINAL | | | |
| STEEL SHEET NO. | STEEL NO. | REHEATING TEMP. (° C.) | TEMP. FDT ° C. | TEMP. CT ° C. | THICK-NESS mm | ROLLING REDUCTION % | THICK-NESS mm | LINE | HEATING TEMP. ° C. | COOLING RATE ° C./s |
| 6-1 | 6A | 1250 | 850 | 600 | 1.2 | — | — | CAL | 880 | 20 |
| 6-2 | 6B | 1250 | 850 | 600 | 1.2 | — | — | CAL | 880 | 20 |
| 6-3 | | | | | | | | | | |
| 6-4 | | | | | | | | | | |
| 6-5 | | | | | | | | | | |
| 6-6 | 6C | 1250 | 850 | 600 | 1.2 | — | — | CAL | 880 | 20 |
| 6-7 | 6D | 1250 | 850 | 600 | 1.2 | — | — | CAL | 880 | 20 |
| 6-8 | 6E | 1250 | 850 | 600 | 1.2 | — | — | CAL | 880 | 20 |
| 6-9 | 6F | 1250 | 850 | 600 | 1.2 | — | — | CAL | 880 | 20 |
| 6-10 | 6G | 1250 | 850 | 600 | 1.2 | — | — | CAL | 880 | 20 |
| 6-11 | 6A | 1250 | 850 | 600 | 4.0 | 70 | 1.2 | CAL | 880 | 20 |
| 6-12 | 6B | 1250 | 850 | 600 | 4.0 | 70 | 1.2 | CAL | 880 | 20 |
| 6-13 | | | | | | | | CAL | 880 | 20 |
| 6-14 | | | | | | | | CAL | 880 | 20 |
| 6-15 | | | | | | | | CAL | 880 | 20 |
| 6-16 | 6C | 1250 | 850 | 600 | 4.0 | 70 | 1.2 | CAL | 880 | 20 |
| 6-17 | 6D | 1250 | 850 | 600 | 4.0 | 70 | 1.2 | CAL | 880 | 20 |
| 6-18 | 6E | 1250 | 850 | 600 | 4.0 | 70 | 1.2 | CAL | 880 | 20 |
| 6-19 | 6F | 1250 | 850 | 600 | 4.0 | 70 | 1.2 | CAL | 880 | 20 |
| 6-20 | 6G | 1250 | 850 | 600 | 4.0 | 70 | 1.2 | CAL | 880 | 20 |
| 6-21 | 6H | 1250 | 850 | 600 | 4.0 | 70 | 1.2 | CAL | 880 | 20 |
| 6-22 | 6I | 1250 | 850 | 600 | 4.0 | 70 | 1.2 | CAL | 880 | 20 |
| 6-23 | 6J | 1250 | 850 | 600 | 4.0 | 70 | 1.2 | CAL | 880 | 20 |
| 6-24 | 6K | 1250 | 850 | 600 | 4.0 | 70 | 1.2 | CAL | 880 | 20 |

| | | | SECONDARY HEAT TREATMENT STEP | | | HOT-DIP GALVANIZING | | | | |
|---|---|---|---|---|---|---|---|---|---|---|
| STEEL | | PICK-LING | KIND | HEAT-ING | COOL-ING | KIND | COOLING RATE AFTER GALVA- | ALLOYING TREATMENT STEP | | TEMPER ROLLING |
| SHEET NO. | STEEL NO. | TREAT-MENT | OF LINE | TEMP. ° C. | RATE* ° C./s | OF LINE | NIZING** ° C./s | | TEMP ° C. | REDUCTION % |
| 6-1 | 6A | YES | CGL | 780 | 20 | CGL | 10 | ALLOYING | 500 | 1.0 |
| 6-2 | 6B | — | CGL | 800 | 20 | CGL | 10 | ALLOYING | 500 | 1.0 |
| 6-3 | | YES | CGL | 800 | 20 | CGL | 10 | ALLOYING | 500 | 1.0 |
| 6-4 | | | CGL | 980 | 20 | CGL | 10 | ALLOYING | 500 | 1.0 |
| 6-5 | | | CGL | 650 | 20 | CGL | 10 | ALLOYING | 500 | 1.0 |
| 6-6 | 6C | YES | CGL | 780 | 20 | CGL | 10 | ALLOYING | 500 | 1.0 |

TABLE 17-continued

| | | | | | | | | | | |
|---|---|---|---|---|---|---|---|---|---|---|
| 6-7 | 6D | YES | CGL | 820 | 20 | CGL | 10 | ALLOYING | 500 | 1.0 |
| 6-8 | 6E | YES | CGL | 800 | 20 | CGL | 10 | ALLOYING | 500 | 1.0 |
| 6-9 | 6F | YES | CGL | 800 | 20 | CGL | 10 | NON-ALLOYING | — | 1.0 |
| 6-10 | 6G | YES | CGL | 800 | 20 | CGL | 10 | ALLOYING | 500 | 1.0 |
| 6-11 | 6A | YES | CGL | 800 | 20 | CGL | 10 | ALLOYING | 500 | 1.0 |
| 6-12 | 6B | — | CGL | 820 | 20 | CGL | 10 | ALLOYING | 500 | 1.0 |
| 6-13 | | YES | CGL | 780 | 20 | CGL | 10 | ALLOYING | 500 | 1.0 |
| 6-14 | | YES | CGL | 980 | 20 | CGL | 10 | ALLOYING | 500 | 1.0 |
| 6-15 | | YES | CGL | 680 | 20 | CGL | 10 | ALLOYING | 500 | 1.0 |
| 6-16 | 6C | YES | CGL | 800 | 20 | CGL | 10 | ALLOYING | 500 | 1.0 |
| 6-17 | 6D | YES | CGL | 800 | 20 | CGL | 10 | NON-ALLOYING | — | 1.0 |
| 6-18 | 6E | YES | CGL | 780 | 20 | CGL | 10 | ALLOYING | 500 | 1.0 |
| 6-19 | 6F | YES | CGL | 800 | 20 | CGL | 10 | ALLOYING | 500 | 1.0 |
| 6-20 | 6G | YES | CGL | 820 | 20 | CGL | 10 | ALLOYING | 500 | 1.0 |
| 6-21 | 6H | YES | CGL | 800 | 20 | CGL | 10 | ALLOYING | 500 | 1.0 |
| 6-22 | 6I | YES | CGL | 800 | 20 | CGL | 10 | ALLOYING | 500 | 1.0 |
| 6-23 | 6J | YES | CGL | 800 | 20 | CGL | 10 | ALLOYING | 500 | 1.0 |
| 6-24 | 6K | YES | CGL | 800 | 20 | CGL | 10 | ALLOYING | 500 | 1.0 |

*COOLING RATE UNTIL 480° C.
**COOLING RATE UNTIL 300° C.

A piece was sampled from the resultant hot-dip galvanized steel strip, and the microstructure, the tensile properties, the strain age hardenability, and the bore expanding property were investigated, as in Example 5.

The results are shown in Table 18.

TABLE 18

| STEEL | | MICROSTRUCTURE | | | | | | PLATED SHEET PROPERTIES TENSILE PROPERTIES | | | |
|---|---|---|---|---|---|---|---|---|---|---|---|
| | | PRIMARY PHASE | | | SECONDARY PHASE | | | | | | |
| | | FERRITE | TEMPERED MARTENSITE | | | RETAINED AUSTENITE | | | | | |
| SHEET NO. | STEEL NO. | VOLUME RATIO % | VOLUME RATIO % | VOLUME RATIO % | KIND* | VOLUME RATIO % | VOLUME RATIO % | YS (MPa) | TS (MPa) | El (%) | TS × El (Mpa %) |
| 6-1 | 6A | 56 | 35 | 91 | A, B | 6 | 9 | 460 | 610 | 35 | 21350 |
| 6-2 | 6B | 52 | 40 | 92 | A, B | 5 | 8 | 475 | 630 | 34 | 21420 |
| 6-3 | | 50 | 40 | 90 | A, B | 6 | 10 | 460 | 610 | 35 | 21350 |
| 6-4 | | 0 | 0 | 0 | M, P, B | 0 | 100 | 660 | 700 | 11 | 7700 |
| 6-5 | | 60 | 40 | 100 | — | 0 | 0 | 620 | 660 | 12 | 7920 |
| 6-6 | 6C | 47 | 45 | 92 | A, B | 5 | 8 | 570 | 620 | 34 | 21080 |
| 6-7 | 6D | 53 | 40 | 93 | A, B | 5 | 7 | 480 | 640 | 33 | 21120 |
| 6-8 | 6E | 57 | 35 | 92 | A, B | 6 | 8 | 390 | 520 | 41 | 21320 |
| 6-9 | 6F | 48 | 45 | 93 | A, B | 5 | 7 | 420 | 560 | 38 | 21280 |
| 6-10 | 6G | 53 | 40 | 93 | A, B | 5 | 7 | 450 | 590 | 36 | 21240 |
| 6-11 | 6A | 53 | 40 | 93 | A, B | 5 | 7 | 465 | 620 | 34 | 21080 |
| 6-12 | 6B | 52 | 40 | 92 | A, B | 5 | 8 | 490 | 650 | 33 | 21450 |
| 6-13 | | 57 | 35 | 92 | A, B | 5 | 8 | 475 | 630 | 34 | 21420 |
| 6-14 | | 0 | 0 | 0 | M, P, B | 0 | 100 | 650 | 710 | 12 | 8520 |
| 6-15 | | 60 | 40 | 100 | — | 0 | 0 | 610 | 650 | 11 | 7150 |
| 6-16 | 6C | 53 | 40 | 93 | A, B | 5 | 7 | 480 | 640 | 33 | 21120 |
| 6-17 | 6D | 62 | 30 | 92 | A, B | 5 | 8 | 490 | 650 | 33 | 21450 |
| 6-18 | 6E | 53 | 40 | 93 | A, B | 4 | 7 | 390 | 520 | 41 | 21320 |
| 6-19 | 6F | 49 | 45 | 94 | A, B | 4 | 6 | 450 | 590 | 36 | 21240 |
| 6-20 | 6G | 42 | 50 | 92 | A, B | 5 | 8 | 460 | 610 | 35 | 21350 |
| 6-21 | 6H | 36 | 55 | 91 | A, B | 5 | 9 | 470 | 630 | 34 | 21420 |
| 6-22 | 6I | 40 | 50 | 90 | A, B | 4 | 10 | 465 | 620 | 34 | 21080 |
| 6-23 | 6J | 50 | 40 | 90 | A, B | 5 | 10 | 480 | 640 | 33 | 21120 |
| 6-24 | 6K | 51 | 40 | 91 | A, B | 5 | 9 | 470 | 620 | 34 | 21080 |

| STEEL | | PROPERTIES AFTER PRE-DEFORMATION-HEAT TREATMENT | | STRAIN AGE HARDENING PROPERTIES | | HOLE EXPANSION HOLE | |
|---|---|---|---|---|---|---|---|
| SHEET NO. | STEEL NO. | $YS_{HT}$ (MPa) | $TS_{HT}$ (MPa) | ΔYS (MPa) | ΔTS (MPa) | EXPANDING RATIO λ % | REMARKS |
| 6-1 | 6A | 705 | 780 | 245 | 170 | 140 | EXAMPLE |
| 6-2 | 6B | 730 | 810 | 255 | 180 | 135 | EXAMPLE |

TABLE 18-continued

| | | | | | | | |
|---|---|---|---|---|---|---|---|
| 6-3 | | 715 | 790 | 255 | 180 | 135 | EXAMPLE |
| 6-4 | | 720 | 730 | 60 | 30 | 55 | COMP. EX. |
| 6-5 | | 660 | 685 | 40 | 25 | 125 | COMP. EX. |
| 6-6 | 6C | 715 | 790 | 145 | 170 | 135 | EXAMPLE |
| 6-7 | 6D | 730 | 810 | 250 | 170 | 130 | EXAMPLE |
| 6-8 | 6E | 620 | 685 | 230 | 165 | 130 | EXAMPLE |
| 6-9 | 6F | 655 | 725 | 235 | 165 | 140 | EXAMPLE |
| 6-10 | 6G | 560 | 620 | 110 | 30 | 50 | COMP. EX. |
| 6-11 | 6A | 720 | 795 | 255 | 175 | 145 | EXAMPLE |
| 6-12 | 6B | 755 | 835 | 265 | 185 | 140 | EXAMPLE |
| 6-13 | | 730 | 810 | 255 | 180 | 140 | EXAMPLE |
| 6-14 | | 720 | 740 | 70 | 30 | 60 | COMP. EX. |
| 6-15 | | 650 | 675 | 40 | 25 | 50 | COMP. EX. |
| 6-16 | 6C | 730 | 810 | 250 | 170 | 140 | EXAMPLE |
| 6-17 | 6D | 740 | 820 | 250 | 170 | 135 | EXAMPLE |
| 6-18 | 6E | 615 | 680 | 225 | 160 | 140 | EXAMPLE |
| 6-19 | 6F | 675 | 750 | 225 | 160 | 135 | EXAMPLE |
| 6-20 | 6G | 700 | 775 | 240 | 165 | 30 | COMP. EX. |
| 6-21 | 6H | 710 | 790 | 240 | 160 | 120 | EXAMPLE |
| 6-22 | 6I | 705 | 785 | 240 | 165 | 120 | EXAMPLE |
| 6-23 | 6J | 720 | 800 | 240 | 160 | 130 | EXAMPLE |
| 6-24 | 6K | 700 | 775 | 230 | 155 | 120 | EXAMPLE |

*M: MARTENSITE,
P: PEARLITE,
B: BAINITE,
A: RETAINED AUSTENITE

All Examples according to the present invention show a high elongation El and a high bore expanding ratio λ, suggesting that the examples are hot-dip galvanized steel sheets having excellent press formability. In addition, all Examples according to the present invention show a very large ΔTS, suggesting that the samples are steel sheets having excellent strain age hardenability. Comparative Examples outside the scope of the invention, in contrast, suggest that the samples are steel sheets having a low elongation El, a low λ, a low ΔTS, and decreased press formability and strain age hardenability.

According to the present invention, it is possible to stably manufacture steel sheets (hot-rolled steel sheets, cold-rolled steel sheets and hot-dip galvanized steel sheets) in which the tensile strength is remarkably increased through a heat treatment applied after press forming while maintaining excellent press formability, giving industrially remarkable effects. When applying a steel sheet of the present invention to automotive parts, there are available advantages of easy press forming, high and stable parts properties after completion, and sufficient contribution to the weight reduction of the automobile body.

What is claimed is:

1. A high-ductility steel sheet excellent in press formability and in strain age hardenability as represented by a ΔTS of not less than 80 MPa, comprising a composite structure containing a primary phase containing a ferrite phase and a secondary phase containing a retained austenite phase in a volume ratio of not less than 1%.

2. A high-ductility steel sheet according to claim 1, wherein the hot-rolled steel sheet has a composition comprising, in weight percent, C: 0.05 to 0.20%, Si: 1.0 to 3.0%, Mn: not more than 3.0%, P: not more than 0.10%, S: not more than 0.02%, Al: not more than 0.30%, N: not more than 0.02%, and Cu: 0.5 to 3.0%, and the balance Fe and incidental impurities.

3. A high-ductility steel sheet according to claim 2, the composition further comprising, in weight percent, at least one of the following Groups A to C:

Group A: Ni: not more than 2.0%;

Group B: at least one of Cr and Mo: not more than 2.0% in total; and

Group C: at least one of Nb, Ti, and V: not more than 0.2% in total.

4. A high-ductility steel sheet according to claim 1, wherein the hot-rolled steel sheet has a composition comprising, in weight percent, C: 0.05 to 0.20%, Si: 1.0 to 3.0%, Mn: not more than 3.0%, P: not more than 0.10%, S: not more than 0.02%, Al: not more than 0.30%, N: not more than 0.02%, at least one of Mo: 0.05 to 2.0%, Cr: 0.05 to 2.0% and W: 0.05 to 2.0%, not more than 2.0% in total, and the balance Fe and incidental impurities.

5. A high-ductility steel sheet according to claim 4, the composition further comprising, in weight percent, at least one of Nb, Ti, and V, in an amount of not more than 2.0% in total.

6. A method for manufacturing a high-ductility hot-rolled steel sheet excellent in press formability and in strain age hardenability as represented by a ΔTS of not less than 80 MPa, comprising the steps of:

hot-rolling a steel slab having a composition comprising, in weight percent, C: not more than 0.20%, Si: 1.0 to 3.0%, Mn: not more than 3.0%, P: not more than 0.10%, S: not more than 0.02%, Al: not more than 0.30%, N: not more than 0.02%, and Cu: 0.5 to 3.0%, into a hot-rolled steel sheet having a prescribed thickness, the hot rolling step including finish-rolling at a finish rolling end temperature of 780 to 980° C.;

cooling the finish-rolled steel sheet to a temperature in the range of 620 to 780° C. within 2 seconds at a cooling rate of not less than 50° C./second;

holding the sheet at the temperature in the range of 620 to 780° C. or slowly cooling the sheet at a cooling rate of not more than 20° C./second for 1 to 10 seconds;

cooling the sheet at a cooling rate of not less than 50° C./second to a temperature of 300 to 500° C.; and coiling the sheet.

7. A method for manufacturing a high-ductility hot-rolled steel sheet excellent in press formability and in strain age hardenability as typically represented by a ΔTS of at least 80 MPa, according to claim 7, the composition further comprising, in weight percent, at least one of the following Groups A to C:

Group A: Ni: not more than 2.0%;

Group B: at least one of Cr and Mo: not more than 2.0% in total; and

Group C: at least one of Nb, Ti, and V: not more than 0.2% in total.

8. A method for manufacturing a high-ductility hot-rolled steel sheet according to claim 6, wherein the steel slab is replaced with a steel slab having a composition comprising, in weight percent, C: 0.05 to 0.20%, Si: 1.0 to 3.0%, Mn: not more than 3.0%, P: not more than 0.10%, S: not more than 0.02%, Al: not more than 0.30%, N: not more than 0.02%, and at least one of Mo: 0.05 to 2.0%, Cr: 0.05 to 2.0% and W: 0.05 to 2.0% in a total amount of not more than 2.0%.

9. A method for manufacturing a high-ductility hot-rolled steel sheet according to claim 8, the composition further comprising, in weight percent, at least one of Nb, Ti, and V in a total amount of not more than 2.0%.

10. A method for manufacturing a high-ductility hot-rolled steel sheet according to claim 6, wherein all or part of the finish rolling is lubrication rolling.

11. A high-ductility steel sheet excellent in press formability and in strain age hardenability as represented by a ΔTS of not less than 80 MPa, comprising a composite structure containing a primary phase containing a ferrite phase and a secondary phase containing a retained austenite phase in a volume ratio of not less than 1%, and having a composition comprising, in weight percent, C: 0.05 to 0.20%, Si: 1.0 to 3.0%, Mn: not more than 3.0%, P: 0.005 to 0.10%, S: not more than 0.02%, Al: not more than 0.30%, N: not more than 0.02%, and Cu: 0.5 to 3.0%, and the balance Fe and incidental impurities.

12. A high-ductility steel sheet excellent in press formability and in strain age hardenability as represented by a ΔTS of not less than 80 MPa, comprising a composite structure containing a primary phase containing a ferrite phase and a secondary phase containing a retained austenite phase in a volume ratio of not less than 1%, and having a composition comprising, in weight percent, C: 0.05 to 0.20%, Si: 1.0 to 3.0%, Mn: not more than 3.0%, P: not more than 0.10%, S: not more than 0.02%, Al: not more than 0.30%, N: 0.0010 to 0.02%, and Cu: 0.5 to 3.0%, and the balance Fe and incidental impurities.

* * * * *